US006525691B2

(12) United States Patent
Varadan et al.

(10) Patent No.: US 6,525,691 B2
(45) Date of Patent: Feb. 25, 2003

(54) MINIATURIZED CONFORMAL WIDEBAND FRACTAL ANTENNAS ON HIGH DIELECTRIC SUBSTRATES AND CHIRAL LAYERS

(75) Inventors: Vijay K. Varadan, State College, PA (US); Kalarickaparambil Vinoy, State College, PA (US); Jose A. Kollakompil, State College, PA (US); Vasundara V. Varadan, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 09/894,973

(22) Filed: Jun. 28, 2001

(65) Prior Publication Data

US 2002/0149519 A1 Oct. 17, 2002

Related U.S. Application Data

(60) Provisional application No. 60/214,381, filed on Jun. 28, 2000.

(51) Int. Cl.[7] ..... H01Q 1/38
(52) U.S. Cl. ..... 343/700 MS; 343/702
(58) Field of Search ..... 343/700 MS, 787, 343/853, 753, 754, 756, 909, 702

(56) References Cited

U.S. PATENT DOCUMENTS

| | | | | |
|---|---|---|---|---|
| 4,948,922 A | | 8/1990 | Varadan et al. | 174/35 |
| 5,245,745 A | * | 9/1993 | Jensen et al. | 343/700 MS |
| 5,557,286 A | | 9/1996 | Varadan et al. | 343/700 |
| RE36,506 E | | 1/2000 | Dempsey et al. | 343/753 |
| 9,595,933 | | 6/2000 | Varadan et al. | 343/787 |
| 6,127,977 A | | 10/2000 | Cohen | 343/700 |
| 6,133,836 A | | 10/2000 | Smith | 340/572.7 |
| 6,172,645 B1 | | 1/2001 | Hollander et al. | 343/702 |
| 6,281,846 B1 | | 8/2001 | Puente Baliarda et al. | 343/700 |
| 6,300,906 B1 | | 10/2001 | Rawnick et al. | 343/700 |
| 6,333,719 B1 | * | 12/2001 | Varadan et al. | 343/787 |

OTHER PUBLICATIONS

International Search Report, dated Dec. 21, 2001. PCT Application No. PCT/US01/41184.

J.R. James and P.S. Hall (eds.), *Handbook of Microstrip Antennas*. Peter Peregrinus, vol. 1, London UK, 1989.

D.M. Pozar, "Microstrip Antennas," *Proc IEEE*, vol. 80, pp. 79–91, 1992.

D.S. Hernandez and I.D. Robertson, "A survey of broadband microstrip patch antennas," *Microwave J.*, vol. 39, No. 9, 1996.

(List continued on next page.)

*Primary Examiner*—Hoang Nguyen
(74) *Attorney, Agent, or Firm*—Ohlandt, Greeley, Ruggiero & Perle, L.L.P.

(57) ABSTRACT

A class of antennas that comprise an electrically conductive fractal pattern disposed on a dielectric substrate and are capable of construction in a size measured in centimeters as compared to previous antennas of the same class that measured in meters. One antenna style has a ground plane that is perpendicular to the substrate and another style has a ground plane that is parallel to the substrate. The substrate has a dielectric constant of in the range of about 10 to 600 or more and may be a ferroelectric, such as barium strontium titanate. A bias voltage applied across the substrate can tune the antenna for operation in a particular frequency range. The antenna can be made especially wideband by placing an absorbing material behind the substrate. The fractal pattern may be any fractal pattern, such as Hilbert curve, Koch curve, Sierpinski gasket and Sierpinski carpet. One style of the antenna uses a fractal pattern that has a plurality of segments arranged in a first configuration and a switch disposed to alter the first configuration to one or more other configurations. The antenna elements may also be arranged in a phased array.

48 Claims, 19 Drawing Sheets

OTHER PUBLICATIONS

N. Cohen, "Fractal antenna applications in wireless telecommunications," in *Professional Program Proceedings of the Electronics Industries Forum*, May 6–8 1997, Boston MA, pp. 43–49, 1999.

Puente et al., "Fractal multiband antenna based on Sierpinski gasket," *Electron. Lett.*, vol. 32, pp. 1–2, 1996.

Puente et al., "On the behavior of the Sierpinski multiband fractal antenna," *IEEE Trans. Antennas Propagat.*, vol. AP–46, pp. 517–524, 1998.

Puente et al., "Small but long Koch fractal monopole," *Electronics Letters*, vol. 34, pp. 9–10, 1998.

B.B. Mandelbrot, *The Fractal Geometry of Nature*. New York: W.H. Freeman & Co., 1983.

A.E. Jacquin, "Fractal image coding: A review," *Proc. IEEE*, vol. 81, pp. 1451–1465, 1993.

Jeng et al., "Fractal finite element mesh generation for vibration problems," *J. Acoust. Soc. Amer.*, vol. 82, pp. 1829–1833, 1987.

Lakhtakia et al. "Self–similarity in Diffraction by a self similar fractal screen," *IEEE Trans. Antennas Propagat.*, vol. AP–35, pp. 236–239, 1987.

Holter et al., "On a new class of fractals: the Pascal–Sierpinski gaskets," *J. Phys. A*, vol. 19, pp 1753–1759, 1986.

Jaggard. "On fractal electrodynamics," *Recent Advances in Electromagnetic Theory*, Springer–Verlag, 1990, pp 183–224.

Jaggard. "Fractal Electrodynamics: Wave interactions with discretely self similar structures," *Electromagnetic Symmetry*. Taylor, 1995, pp 231–280.

Werner et al. "An overview of fractal electrodynamics research," Proc. Of the 11$^{th}$ Annual review of Progress in Applied computational Electromagnetics, 1995, pp 964–969.

Werner et al. "Fractal constructions of Linear and planar arrays," Proc of 1997 IEEE Symp. pp 1968–1971, 1997.

Werner et al. "On the synthesis of fractal radiation patterns," *Radio Science*, vol. 30, pp 29–45, 1995.

Varadan et al. "Novel microwave planar phase shifter," *Microwave J.*, vol. 38, 1995.

Jose et al. "Electronically tunable microstrip patch antenna," *Microwave Opt. Technol. Lett.*, vol. 20 (1999), pp 166–169.

Herneti et al. "Effect of various dopants on the dielectric properties of barium strontium titanate," *Materials Lett.*, vol. 15, pp 317–324, 1993.

Ro et al. "Electromagnetic activity and absorption in microwave chiral composites," *IEE Proc. Tp. H, Microwaves, Antennas and Propagation*, vol. 139, pp 441–448, 1992.

Lakhtakia et al., *Time Harmonic Electromagnetic Fields in Chiral Media*. Springer Verlag, New York, 1989.

Guire et al. "Influence of chirality on the reflection of EM waves by planar dielectric slabs," *IEEE Trans. Electromag. Compat.*, vol. 32, pp. 300–303, 1990.

Varadan et al. "Measurement of electromagnetic properties of chiral composite materials in 8–40 GHz range," *Radio Science*, vol. 29, pp. 9–22, 1994.

Varadan et al. "Smart skin spiral antenna with chiral absorber," Proceedings of SPIE—1995: Smart Electronics, vol. 2448, pp. 68–79, 1995.

Nakano et al. "Shortening ratios of modified dipole antennas," *IEEE Trans. Antennas Propagat.*, vol. AP–32, pp. 385–386, 1984.

Warnagiris et al. "Performance of a meandered line as an electrically small transmitting antenna," *IEEE Trans. Antennas Propagat.*, vol. AP–46, pp. 1797–1801, 1998.

Vinoy et al., "Hilbert curve fractal antenna: A small resonant antenna for VHF/UHF applications," *Microwave and optical Technology Letters*, vol. 29, pp. 215–219, May 20, 2001.

Vinoy et al. "Hilbert curve fractal antennas with Reconfigurable characteristics," In: *IEEE–MTTS International Symposium*, May 20–25, 2001. Degest vol. 1, pp. 381–384, 2001.

Stevens, Fractal Programming in C. Redwood City, M&T Books. 1989.

* cited by examiner

FIG. 16
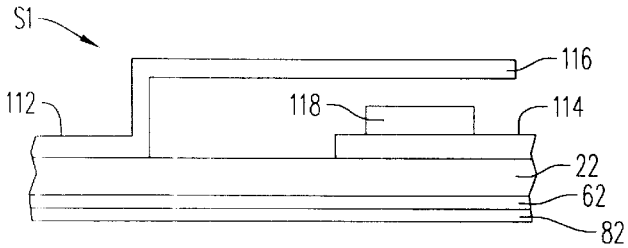
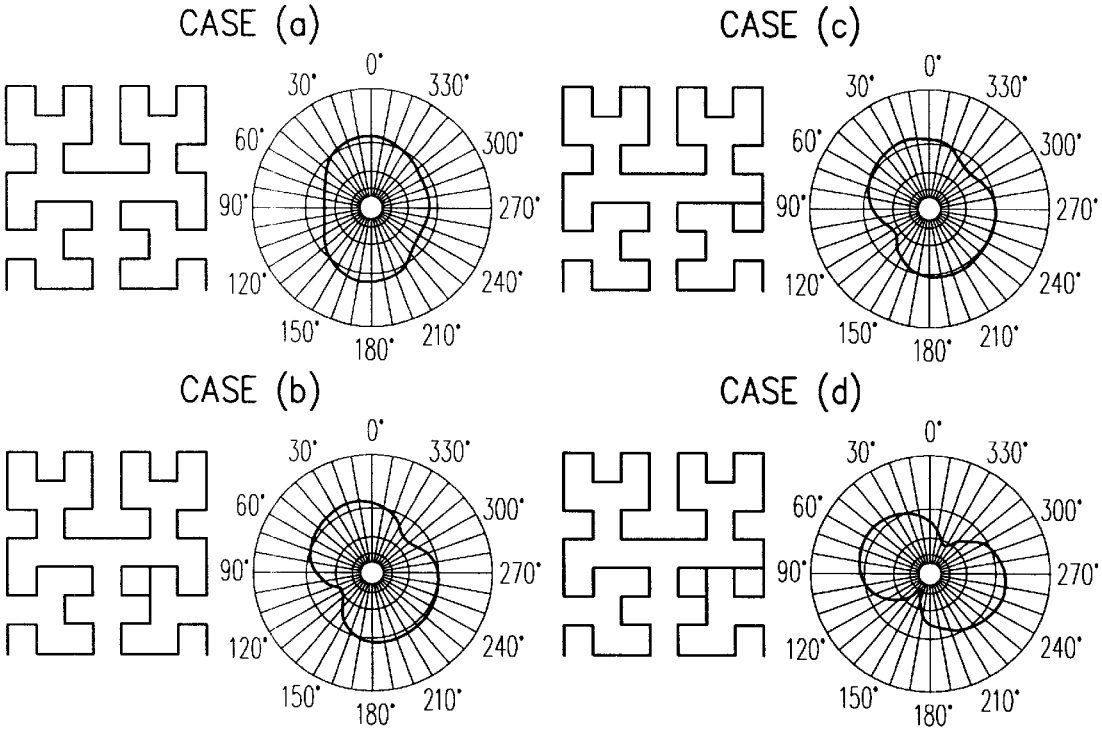
FIG. 17
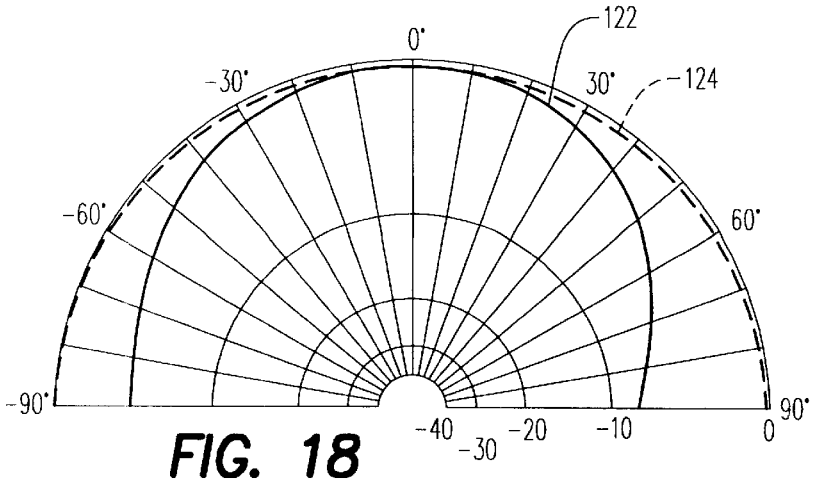
FIG. 18

100

| CASE STUDY | PEAK 1 DIRECTION | GAIN | PEAK 2 DIRECTION | GAIN | ±' 3dB BEAM WIDTH |
|---|---|---|---|---|---|
| (a) | 0 | 1.56 | 177 | 1.81 | 83 |
| (b) | 18 | 1.28 | 193 | 0.95 | 107 |
| (c) | 19 | 1.55 | 195 | 1.33 | 100 |
| (d) | 63 | 1.74 | 254 | 2.35 | 92 |

| CASE | ELEMENT 1 PHASE | ELEMENT 2 PHASE | ELEMENT 3 PHASE | ELEMENT 4 PHASE | BEAM DIRECTION |
|---|---|---|---|---|---|
| 1 | 0 | 0 | 0 | 0 | 0° |
| 2 | 0 | 20 | 40 | 60 | 8° |
| 3 | 0 | 40 | 80 | 120 | 12° |
| 4 | 0 | 60 | 120 | 180 | 18° |
| 5 | 0 | 90 | 180 | 270 | 28° |
| 6 | 0 | 120 | 240 | 360 | 40° |

158

MINIATURIZED CONFORMAL WIDEBAND FRACTAL ANTENNAS ON HIGH DIELECTRIC SUBSTRATES AND CHIRAL LAYERS

This application claims the benefit of U.S. Provisional Patent Application, Ser. No. 60/214,381, filed on Jun. 28, 2000.

FIELD OF THE INVENTION

This invention relates to an antenna that is miniature, when compared to prior antennas of the same category. In particular, the antenna of the present invention will be useful for communications that use frequency bands in the mega Hertz (MHz) range or in the giga Hertz( GHz) range.

BACKGROUND OF THE INVENTION

With the widespread proliferation of telecommunication technology in recent years the need for small size antennas has increased many fold. However, the solution is not so simple as arbitrarily reducing antenna size as this would result in a large input reactance and a deterioration in the radiation efficiency.

There is an unprecedented demand for compact electrically small antennas with moderate gain that are compatible with the recent revolutionary advances in the semiconductor industry. With the associated electronics being miniaturized, conventional antennas would not be acceptable to the end user. Reducing the physical size of the antenna and restricting it to a planar configuration has been the aim of antenna designers. However, most of the low frequency communication antennas currently operating in land, air and maritime mobile systems are of either low bandwidth or large size. Mobile antenna development is no longer confined to the design of small light weight antennas but it is more of a creation of a well defined electromagnetic configuration which can contribute significantly in signal processing and data communication in ill-defined and time varying environments. What is needed is an improved bandwidth for antennas of mobile communication systems that could lead to diversity in reception capability, reduction of multi-path fading, and selectivity of polarization characteristics, in addition to the fundamental increase in the speed of information transfer. Also needed is a small size antenna that can be implemented in a conformal configuration that is sleek and aesthetic and will fit in small handheld electronic equipment.

Prior art approaches to extending the bandwidth of conventional antennas have been pursued for few decades, but most of these are not conformal. One type of conformal antenna is the microstrip antenna. However, the microstrip antenna suffers from disadvantages, such as small bandwidth and low gain. Various approaches to improve the bandwidth of microstrip antennas include the use of multilayer structures, parasitic elements, log periodic structures, shorting pins, and specially shaped patches. However, all these methods lead to fabrication difficulties and make the antenna configuration bulky, especially at lower frequencies. Although high dielectric substrates may reduce the size, the gain of the antenna is degraded by their use.

A type of pattern that is non-eucledian has been described in *Fractal Geometry of Nature,* 1983, by B. B. Mandelbrot. Mandelbrot contended that it is possible to describe many of the irregular and fragmented patterns in nature to full-fledged theories by identifying a family of shapes called "fractals". The geometric self-similarity of these patterns has been very enthusiastically followed in many fields of engineering (e.g., remote sensing, pattern recognition, signal processing, etc.). The self-similar nature of fractal patterns has been studied widely and is used in many fields of science and engineering, such as image processing and pattern recognition. Although a large number of fractal patterns have been described, one pattern, known as the Sierpinski gasket, is popular in engineering applications, such as finite element methods. For example, Pascal-Sierpinski gaskets have been used in finite element mesh generation for vibration problems with a significant reduction in the computation time and storage requirements. While analyzing the basic vibration properties, computation time and memory requirements in comparison to traditional meshing approaches, a new mesh generation based on geometric fractals offers much promise in significantly reducing storage requirements and computation time. The use of fractal structures to solve problems involved in array synthesis has been described in an article, *Self-Similarity in Diffraction by a Self Similar Fractal Screen,* IEEE Transactions Antennas Propagation, vol. Ap-35, pages 236–239, 1987 and in an article, *On a New Class of Fractals:the Pascal-Sierpinski Gaskets,* Journal of Applied Physics, Vol. 19, pages 1753–1759, 1986. Natural fractals in random structures like thin films, clouds and percolating clusters are used in understanding the material growth and morphology. An elementary first order electromagnet (EM) theory was used to elucidate the fractal screen by perforating an infinitely large, infinitesimally thin and perfectly conducting sheet by identical, small circular apertures.

Although the mathematics of fractals has been known for most of the twentieth century, the application of the fractal patterns to antenna technology is relatively new. The subject of fractal electrodynamics has been addressed in the references, *On Fractal Electrodynamics, Recent Advances in Electromagnetic Theory,* pages 183–224, 1990; *Fractal Electrodynamics: Wave Interactions With Discretely Self Similar Structures,* Electromagnetic Symmetry, pages 231–280, 1995; *An Overview of Fractal Electrodynamics Research,* Proceedings of the $11^{th}$ Annual review of Progress in Applied Computational Electromagnetics, pages 964–969, 1995; *Fractal Constructions of Linear and Planar Arrays,* Proceedings of 1997 IEEE Symposium, pages 1968–1971, 1997; and *On the Synthesis of Fractal Radiation Patterns,* Radio Science, Vol. 30, pages 29–45, 1995.

Antennas with fractal patterns disposed on relatively low dielectric (dielectric constant of 2 to 3) substrates have been reported in the references, *Fractal Antenna Applications in Wireless Telecommunications,* Professional Program Proceedings of the electronics Industries Forum, pages 43–49, 1999 and *Fractal Multiband Antenna Based on Sierpinski Gasket,* IEEE Transactions Antennas Propagation, Vol. AP-46, pages 517–524, 1998. These references show that various fractal antennas improve the features of a conventional monopole antenna. However, to the best of the knowledge of the inventors, there is no study available to the effect of dielectric constant of the substrates in the performance of fractal antennas.

U.S. Pat. No. 4,948,922 describes an absorbent material comprised of a chiral substance.

U.S. Pat. No. 5,557,286 describes an antenna with a barium strontium titanate (BST) ceramic and a capability to tune the dielectric constant of the BST material. A copending United States patent application, Ser. No. 09/595,933, describes a tunable dual-band antenna having a BST material. However, neither the aforementioned patent nor application describes an antenna with a fractal pattern.

Antennas with the capability to change their radiation characteristics or operational frequency adaptively are generally classified as reconfigurable antennas. Reconfigurable antennas have been conventionally pursued for satellite communication applications, where it often is required to change the broadcast coverage patterns to suit the traffic changes. Reconfigurable antennas also find applications in a modern telecommunications scenario, where the same antenna could be shared between various functions (requiring frequency switching), or the antenna radiation characteristics could be altered as done in smart antennas, using signal processing techniques. In addition, reconfigurable antenna systems can also find applications in collision avoidance radars.

SUMMARY OF THE INVENTION

An antenna of the present invention has a substrate with a dielectric constant of at least 10 with an electrically conductive layer comprising a fractal pattern. A body or sheet of electrically conductive material is provided as a ground plane. A bias voltage is applied across the substrate to tune the antenna for operation in at least one frequency band. Input energy is fed via an input feed to the fractal pattern layer. The fractal pattern may be any suitable fractal pattern, such as Hilbert curve, Koch curve, Sierpinski gasket and Sierpinski carpet.

The antenna of the invention is capable of operation across an extremely large portion of the frequency spectrum including frequencies in the MHz range to frequencies in the GHz range. Also, the antenna can be constructed in a miniature size measured in centimeters compared to prior art antennas of the same class that have a size measured in meters. Also, the antenna is capable of being constructed in shapes that conform to a surface of an object, such as clothing, a vehicle, and the like.

In one class of embodiments of the invention, the ground plane is disposed substantially perpendicular to the substrate. In another class of embodiments of the invention, the ground plane is disposed substantially parallel to the substrate.

In some embodiments of the invention, the substrate is comprised of a ferroelectric material, which is preferably barium strontium titanate.

In some embodiments of the invention, a layer of absorbing material overlies a surface of the substrate opposite to the fractal pattern. The absorbing material layer smoothens the frequency/return loss characteristic of the antenna, thereby improving the wide band operation thereof. Preferably, the absorbing material is a chiral material.

In some embodiments of the antenna of the present invention, the dielectric constant is in the range of about 10 to about 200. In other embodiments the dielectric constant is in the range of about 200 to 600.

An alternative embodiment of the antenna of the present invention comprises first and second assemblies that each has a substrate of dielectric material having a first surface and a second surface and a fractal pattern electrically conductive layer that overlies the first surface of the substrate. A layer of absorbing material is disposed between the second surfaces of the first and second assemblies. A body or sheet of electrically conductive material is disposed in relation to the first and second assemblies so as to serve as a ground plane. In one style of this alternative embodiment, the ground plane is substantially perpendicular to the substrates and gives the antenna the capability of radiating energy in at least a hemispherical volume. In another style, the ground plane is disposed between and substantially parallel to the substrate so as to give the antenna the capability of radiating in substantially a spherical volume. This style of antenna has two absorbing layers, one disposed between the ground plane and one of the substrates and the other disposed between the ground plane and the other substrate.

In another alternative embodiment of the antenna of the present invention, an electrically conductive fractal pattern layer overlies a surface of a dielectric substrate. The fractal pattern has a plurality of segments arranged in a first configuration. One or more switches are disposed to change the first configuration to a second configuration. Preferably, the fractal pattern is a Hilbert curve. In some styles of this alternative embodiment, the dielectric substrate has a dielectric constant of at least 10. In other styles the dielectric constant is in the range of about 10 to about 200 or in the range of about 200 to about 600. The dielectric substrate may comprise a ferroelectric, which is preferably barium strontium titanate. Also, a bias voltage may be applied across the substrate for tuning purposes.

In another alternative embodiment of the invention, a plurality of fractal antennas are arranged in an array with a feed network that is capable of delivering signals thereto in a phased relation.

BRIEF DESCRIPTION OF THE DRAWINGS

Other and further objects, advantages and features of the present invention will be understood by reference to the following specification in conjunction with the accompanying drawings, in which like reference characters denote like elements of structure and:

FIG. 16 is a view taken along line 16—16 of FIG. 14;

FIGS. 17 and 18 depict radiation patterns for various configurations of the antenna of FIG. 14;

DESCRIPTION OF THE PREFERRED EMBODIMENT

Figure 1A:
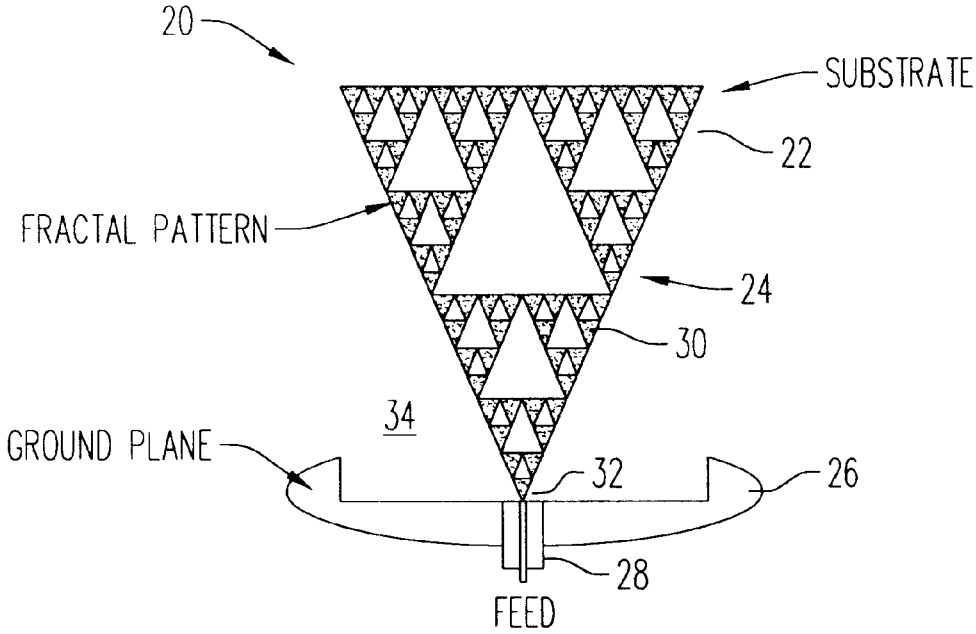
FIG. 1A is a perspective view of an antenna of the present invention.

Referring to FIG. 1A, an antenna 20 has a substrate 22, a layer of electrically conductive material 24, a sheet of electrically conductive material 26 and an input feed 28. Substrate 22 is a high dielectric material. Preferably, the dielectric constant of substrate is at least 10 or more. In some embodiments, the dielectric constant can be in the range of 10 to 600.

Layer 24 includes a fractal pattern 30. Input feed 28 is electrically and/or magnetically coupled to a feed point 32 of conductive layer 24. Feed point 32 is the apex of the triangular fractal pattern 30 for the design of FIG. 1A. It will be apparent to those skilled in the art that the feed point can be at other locations of fractal pattern 30. Layer 24 overlies a surface 34 of substrate 22. Substrate 22 and layer 24 are supported by supports (not shown) on electrically conductive sheet 26 so that sheet 26 is substantially perpendicular to surface 34 of dielectric substrate 22. Electrically conductive sheet 26 functions as a ground plane for antenna 20.

Electrically conductive layer 24 may be any suitable electrically conductive material and is preferably a metal, such as copper. Electrically conductive sheet 26 may be any suitable electrically conductive material and is preferably a metal, such as aluminum.

Figure 1C:
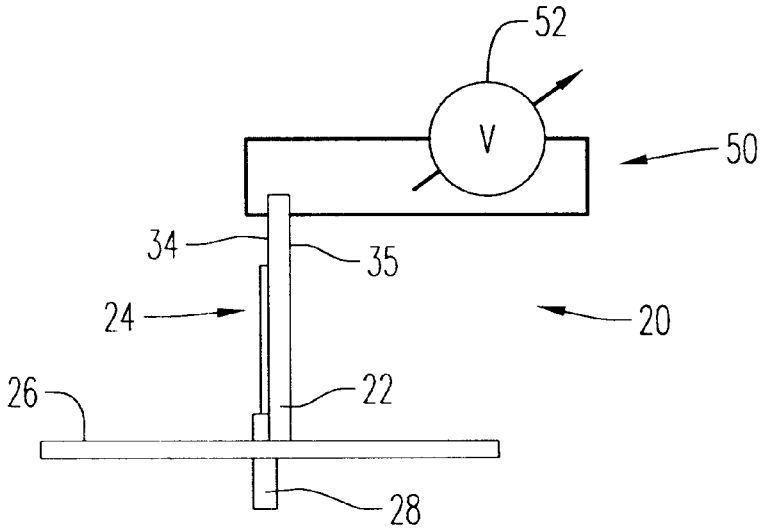
FIG. 1C is an elevational view of the antenna of FIG. 1.
Figure 1B:
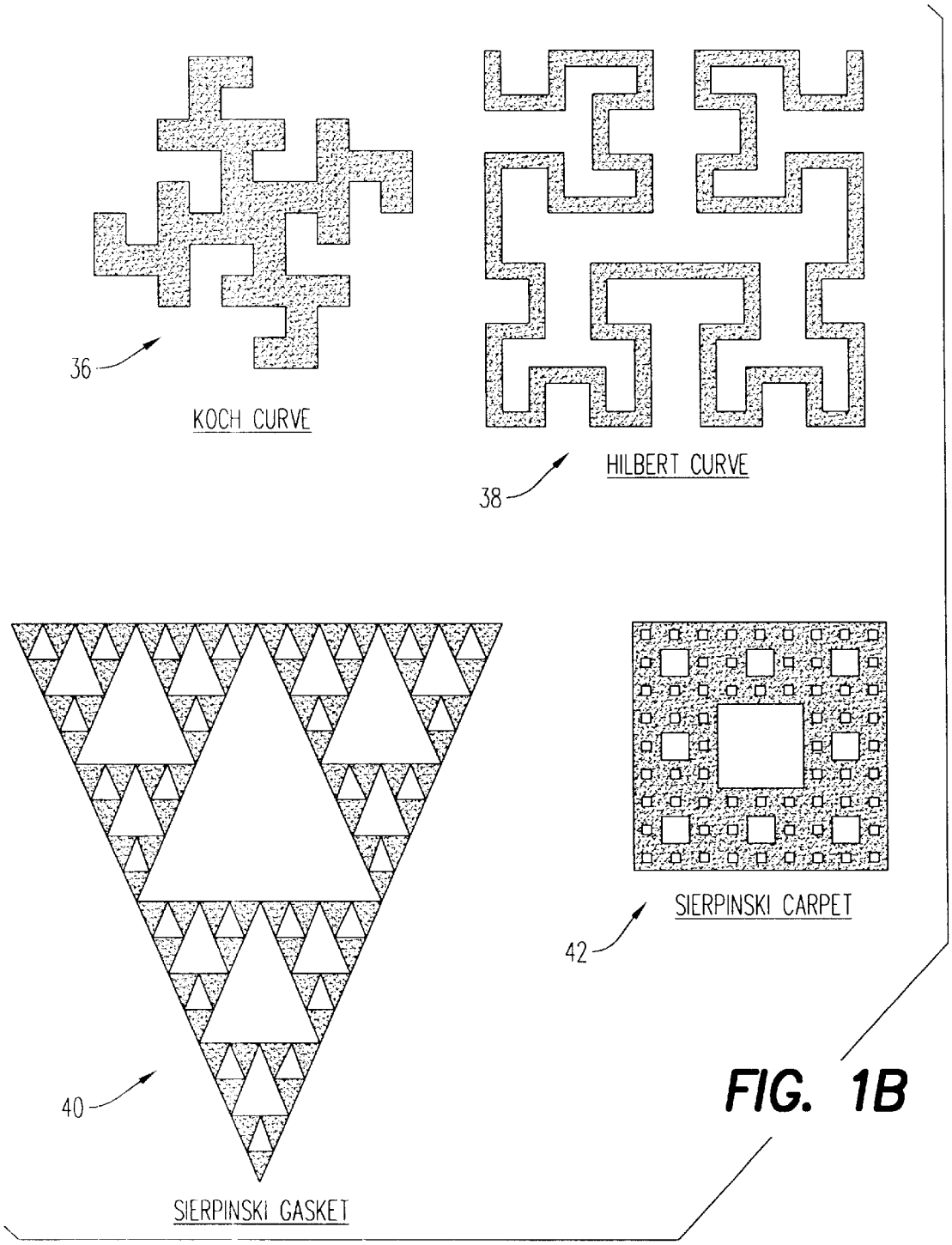
FIG. 1B depicts a variety of fractal patterns for the antenna of FIG. 1A.

Referring to FIG. 1B, some examples of fractal patterns that can be used for layer 24 include a Koch curve 36, a Hilbert curve 38, a Sierpinski gasket 40 and a Sierpinski carpet 42. Layer 24 of FIG. 1, includes a Sierpinski gasket fractal pattern. It will be apparent to those skilled in the art that layer 24 could alternatively include fractal patterns 36, 38, 42 or others not shown.

Referring to FIG. 1C, a tuning means 50 includes a variable bias voltage source 52 connected across substrate 22 with connections to surface 34 and an opposed surface 35.

Figure 2:
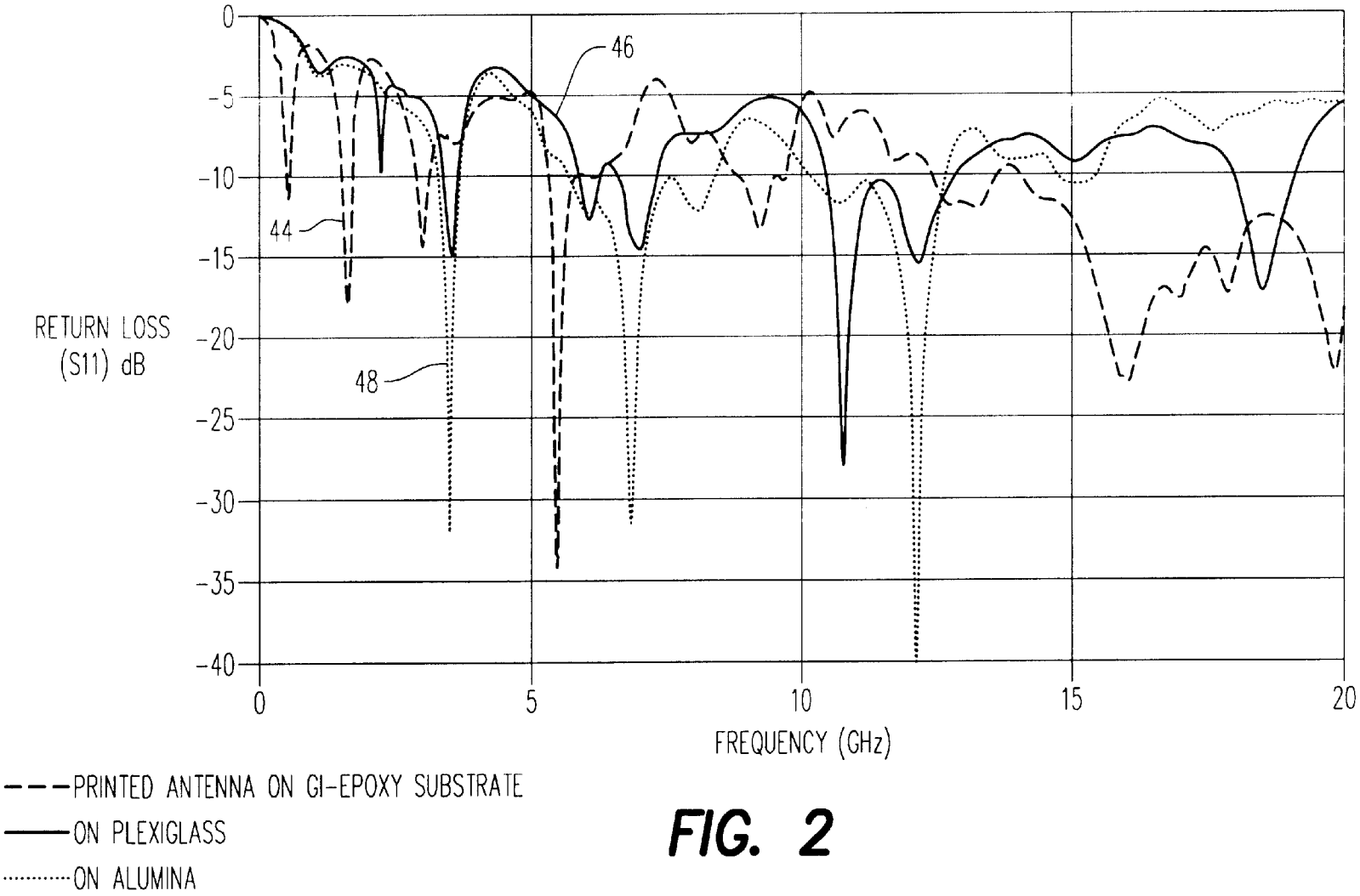
FIG. 2 is a graph depicting the frequency/return loss characteristic for the antenna of FIG. 1 for different substrates.

Referring to FIG. 2, the return loss characteristics are shown for antenna 20 with three different materials for substrate 22. A curve 44 is for the return loss characteristic for a substrate material of GI-epoxy, a curve 46 is for a substrate material of Plexiglass, and a curve 48 is for a substrate of alumina. Curves 44,46 and 48 show that the resonant frequencies of antenna 20 change with the materials used for substrate 22. The return loss characteristic is a measure of the energy reflected back to the feed at the antenna input terminals and, hence, shows the impedance match of the antenna with standard feeding configurations. When connected to a port of a properly calibrated network analyzer (not shown), the return loss is measured as S11. A cut off value of 10 or 15 dB is chosen in many applications. The resonant frequencies of antenna 20 for these materials are found to coincide to a certain extent, though a general trend can not be inferred by these results since the thickness of the available substrate materials also differed. The results, however, confirm that the antenna configuration remains multi-band, and is not greatly perturbed by the substrate properties. The resonant frequencies occur approximately at geometric periods with a multiplicity of nearly 2.

Figure 3:
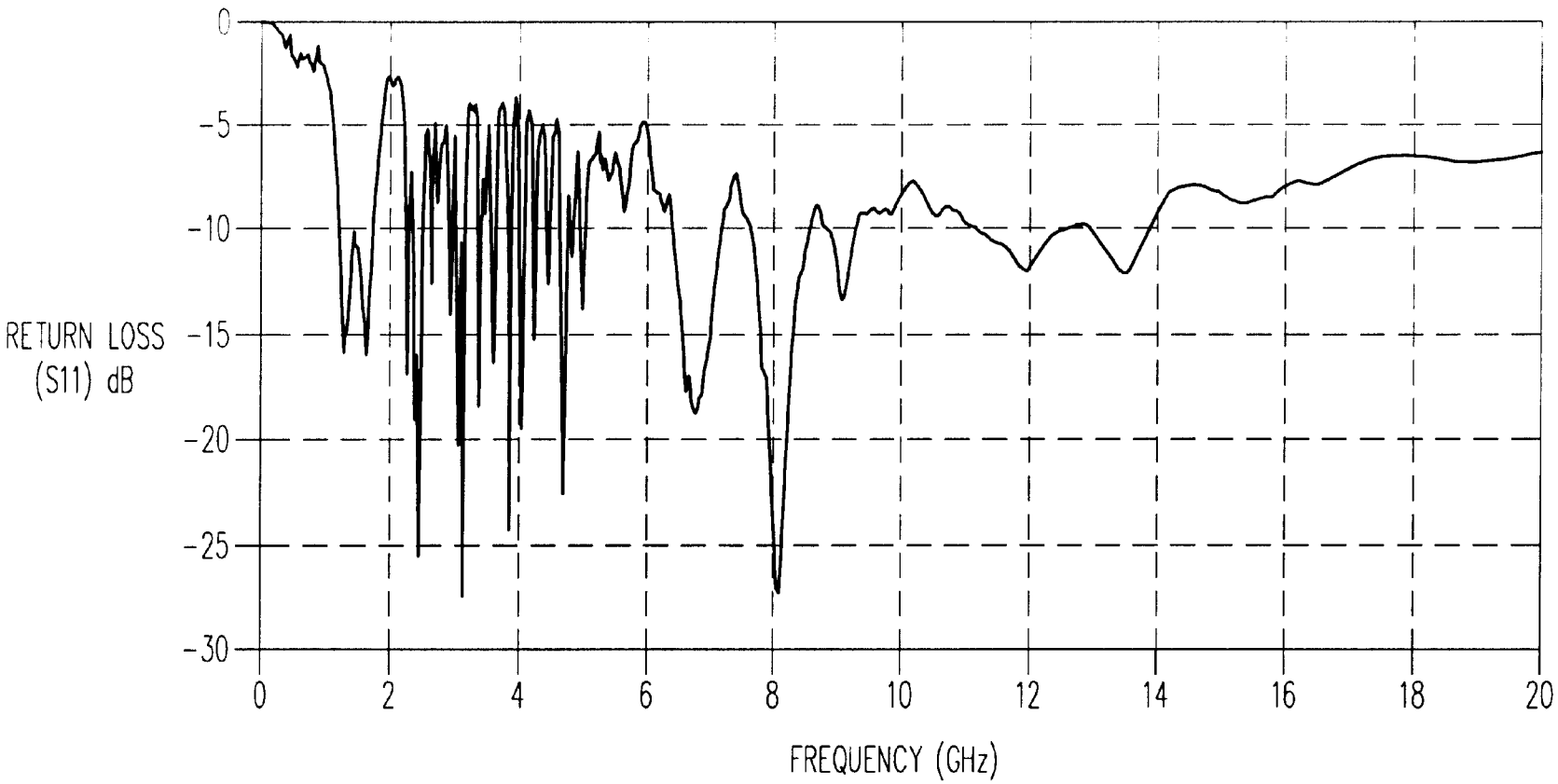
FIGS. 3 and 4 are graphs depicting the frequency/return loss characteristic for the antenna of FIG. 1 for ferroelectric substrates of differing dielectric constants.
Figure 4:
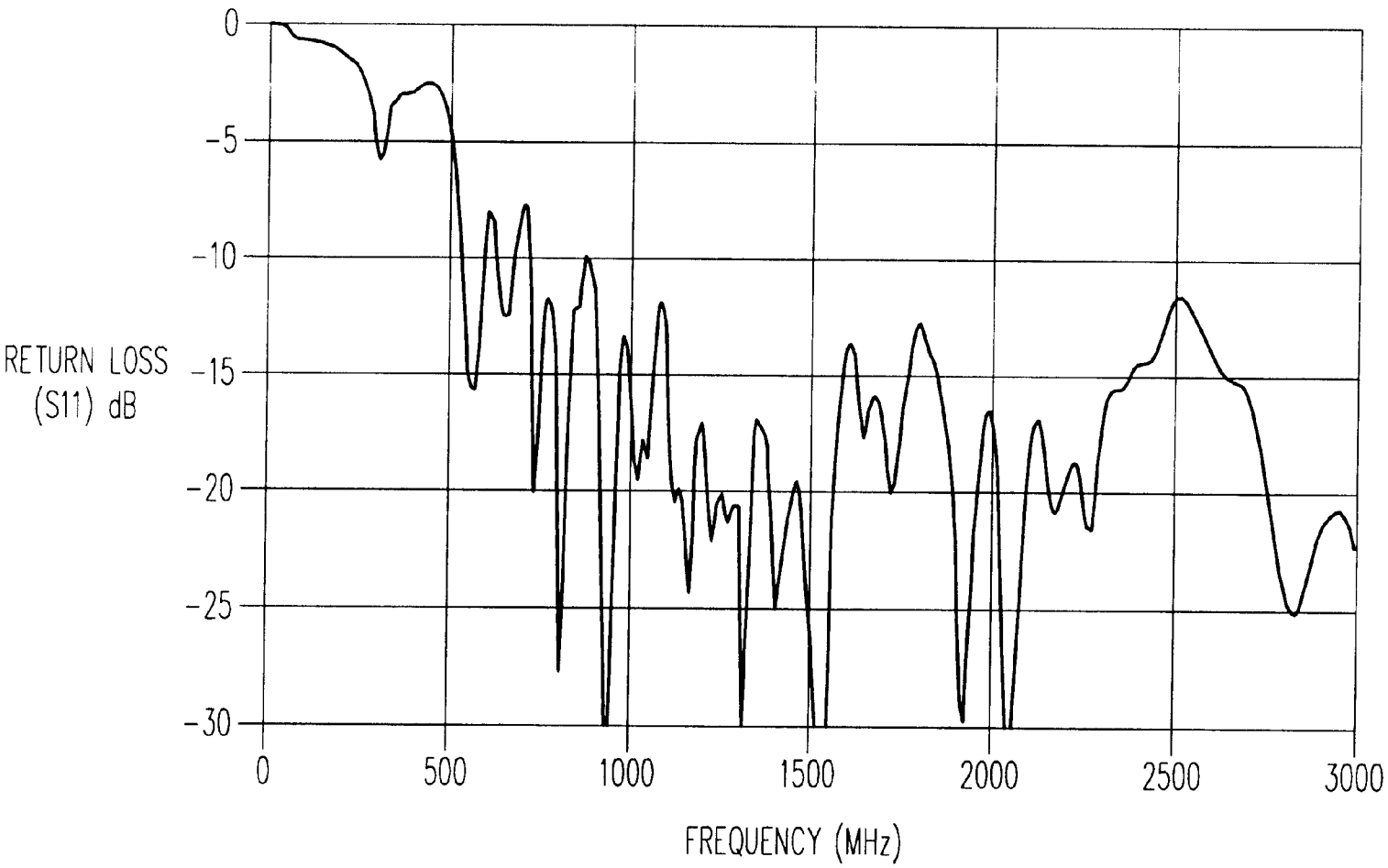

Referring to FIG. 3, the return loss characteristic is shown for antenna 28 with a ferroelectric substrate material, such as barium strontium titanate (BST). It will be apparent to those skilled in the art that other low loss perovskite and paraelectric films may also be used. These ferroelectric materials can be formed to have dielectric constants with values up to 600 or more. In FIG. 4, a large number of distinctive but smaller bands of frequencies, particularly in the region of 1 GHz to 10 GHz, are shown to have good input impedance characteristics as compared to the finite number of bands obtained with the substrate materials of GI-epoxy, Plexiglass and alumina (FIG. 3). The BST substrate used in this antenna configuration has a dielectric constant of 50.

Referring to FIG. 4, the return loss characteristic is shown for a BST substrate having a dielectric constant of 500. The higher dielectric constant considerably lowers the minimum operational frequency of antenna 28. Similar results prevail for ferroelectric materials with dielectric constants in the range of 200 to 500. FIG. 4 shows that the antenna has a very good input match for frequencies above 500 MHz. This result enhances the scope of this class of antennas as they become suitable at the UHF band.

Antenna 28 exhibits a multi-band frequency/return loss characteristic. With substrate 22 having a lower dielectric constant in the range of 2.2 to 100, the multi-band performance is in the GHz range. When substrate 22 has a higher dielectric constant in the range of about 100 to 600 and higher, the multi-band performance is in the MHz range. Tuning means 50 (FIG. 1C) is operable to tune antenna 28 to any of these bands, using tunable dielectric materials and films.

It is the belief of the inventors that the results exhibited by FIGS. 2, 3 and 4 are due to the waves excited on the dielectric substrate itself. Accordingly, it has discovered that changing the field distribution on the substrate can modify the frequency/return loss characteristic. In particular, the closely clustered multiple bands in the return loss characteristic can be smoothened by placing an absorber behind the substrate.

Figure 5A:
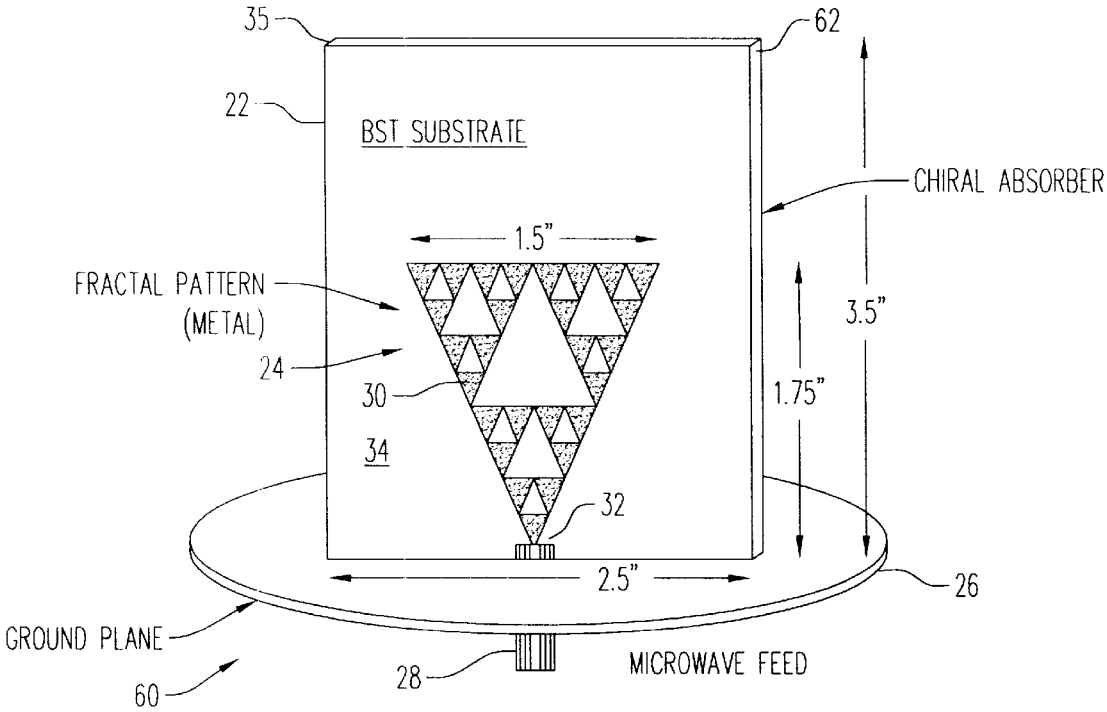
FIG. 5A is a perspective view of an alternate embodiment of the antenna of the present invention.

Referring to FIG. 5A, an alternative embodiment of the present invention is an antenna 60 that is identical to antenna 28 in all respects except that an absorber 62 overlies opposed surface 35 of substrate 22. Absorber 62 is preferably a chiral absorber. Antenna 60 may also include a tuning means, such as tuning means 50 of FIG. 1C, though not shown in FIG. 5A.

Figure 6:
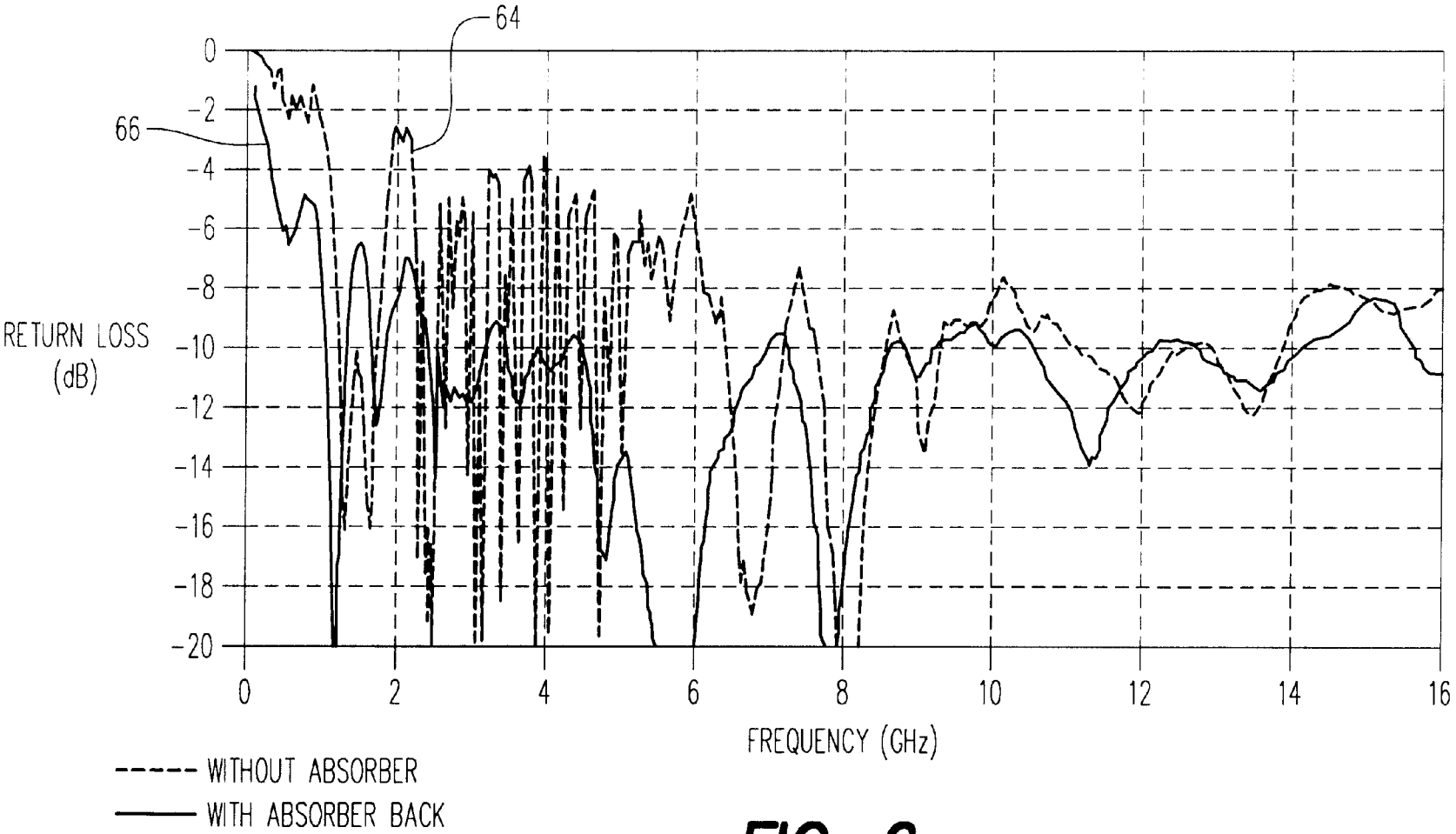
FIGS. 6 and 7 are graphs depicting the frequency/return loss characteristic for the antenna of FIG. 5A for ferroelectric substrates of differing dielectric constants.

Referring to FIG. 6, absorber 62 acts to even out the ripple in the frequency/return loss characteristic of antenna 60. A curve 64 shows the characteristic without absorber 62 and a curve 66 shows the characteristic with absorber 62. The substrate material for this example is BST with a dielectric constant of about 50. The measured input impedance of antenna 60 shows that it has wideband performance. A properly matched absorbing material 62 behind substrate 22 brings down the surface waves, as shown by curve 66. The return loss of antenna 60 is well below −7.5 dB (VSWR~2.5) entirely for frequencies ranging from 2.2 to 16 GHz. However, the average return loss $S_{11}$ is well below −10 dB (VSWR~2) within this band.

Figure 7:
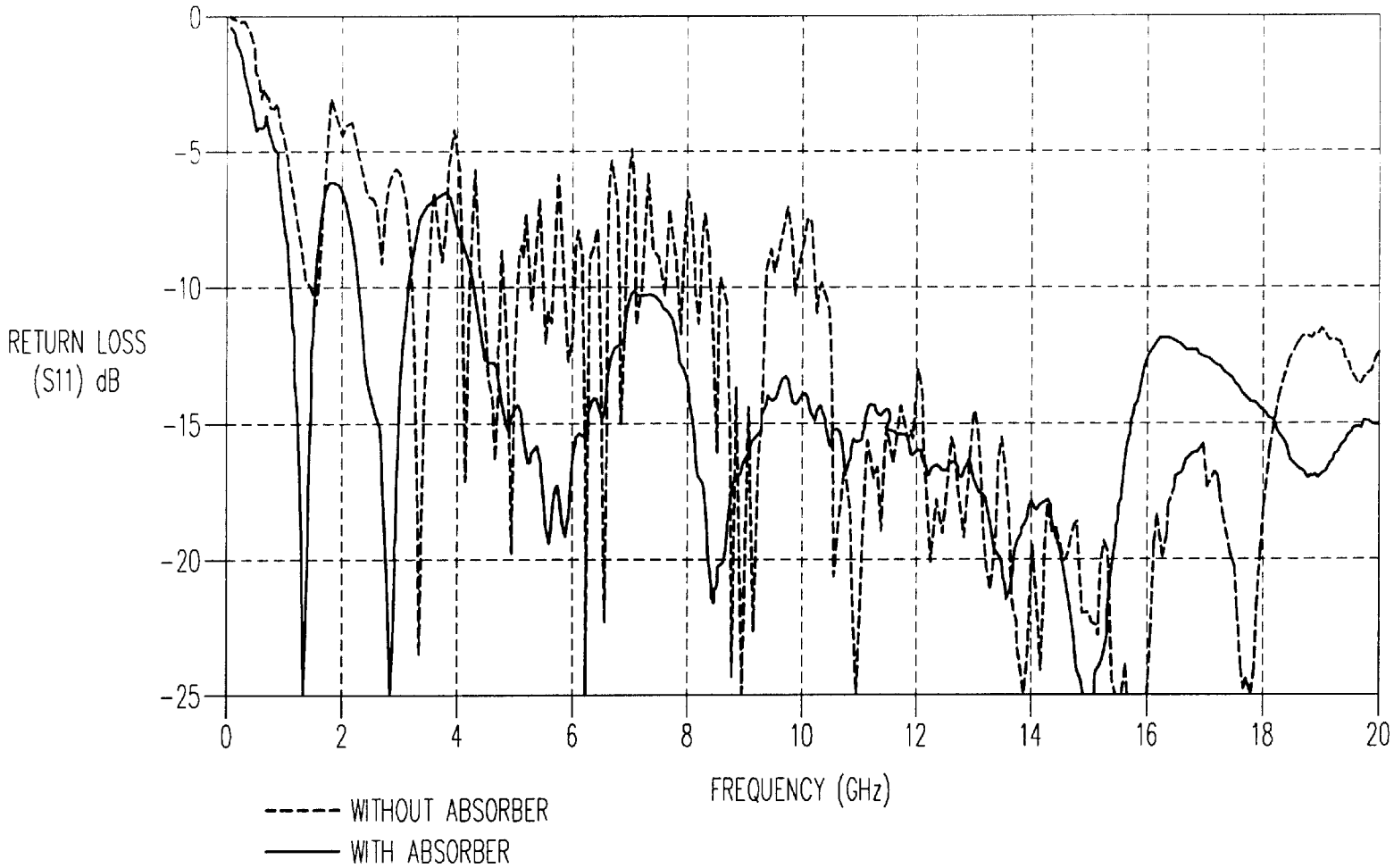

It may, however, be pointed out that no considerable increase in bandwidth is observed when low dielectric constant substrates are used along with the absorber. However widening of bandwidths are obtained when BST substrates of a wide range of dielectric values. For example, FIG. 7 shows the results from a BST substrate of a lower dielectric constant of about 12. It can be seen that for lower dielectric constant substrates, the improvement in bandwidth is marginal.

Figure 8:
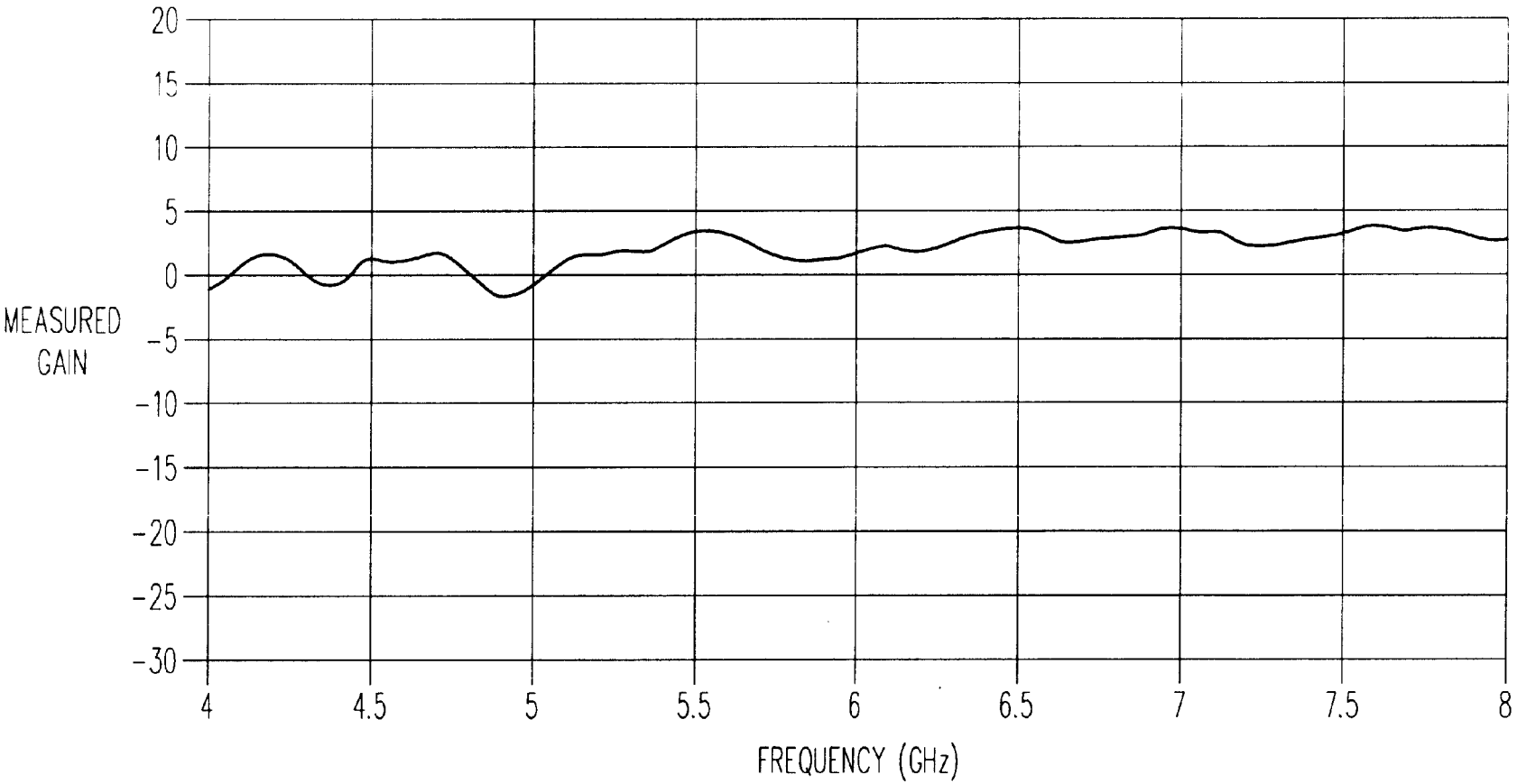
FIG. 8 is a graph depicting the gain of the antenna of FIG. 5A.

The radiation characteristics of antenna 60 are comparable with that of antenna 20, but with wider bandwidth. The radiation pattern of antenna 60 was measured in an anechoic chamber with automated measurement systems using a network analyzer (not shown). The measured absolute gain in the C-band is shown in FIG. 8. The gain was measured by a comparison method. A standard antenna was used to transmit the signals at the frequencies of interest. The test antenna 60 was used as a receiving antenna, following the procedure outlined in the relevant IEEE standard. The gain characteristic shown in FIG. 8 is fairly uniform, demonstrating the wideband characteristics of the antenna.

Figure 9:
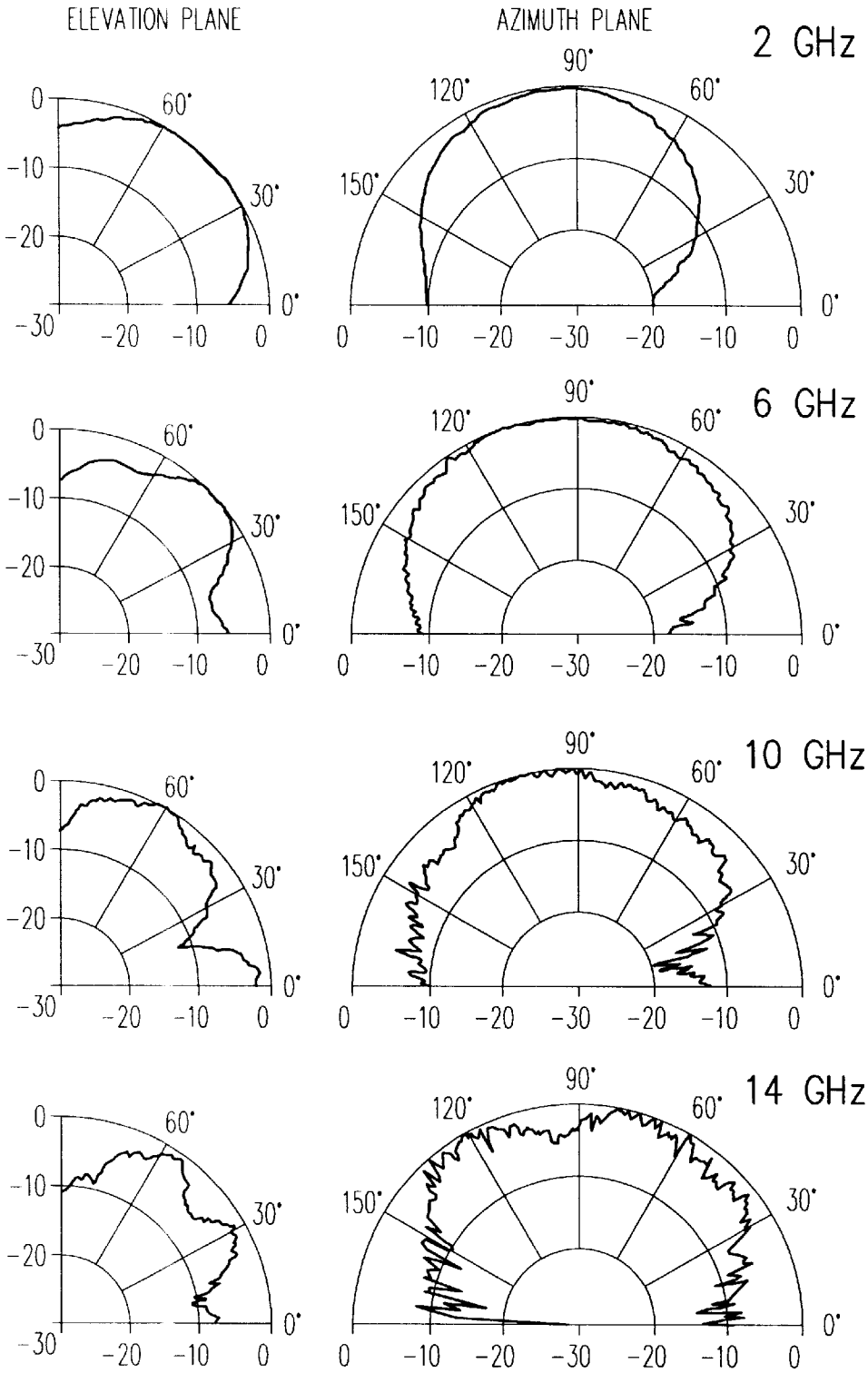
FIGS. 9 and 10 depict the radiation patterns in the elevation and azimuth planes for different frequencies of the antenna of FIG. 5A for different dielectric constants.
Figure 10:
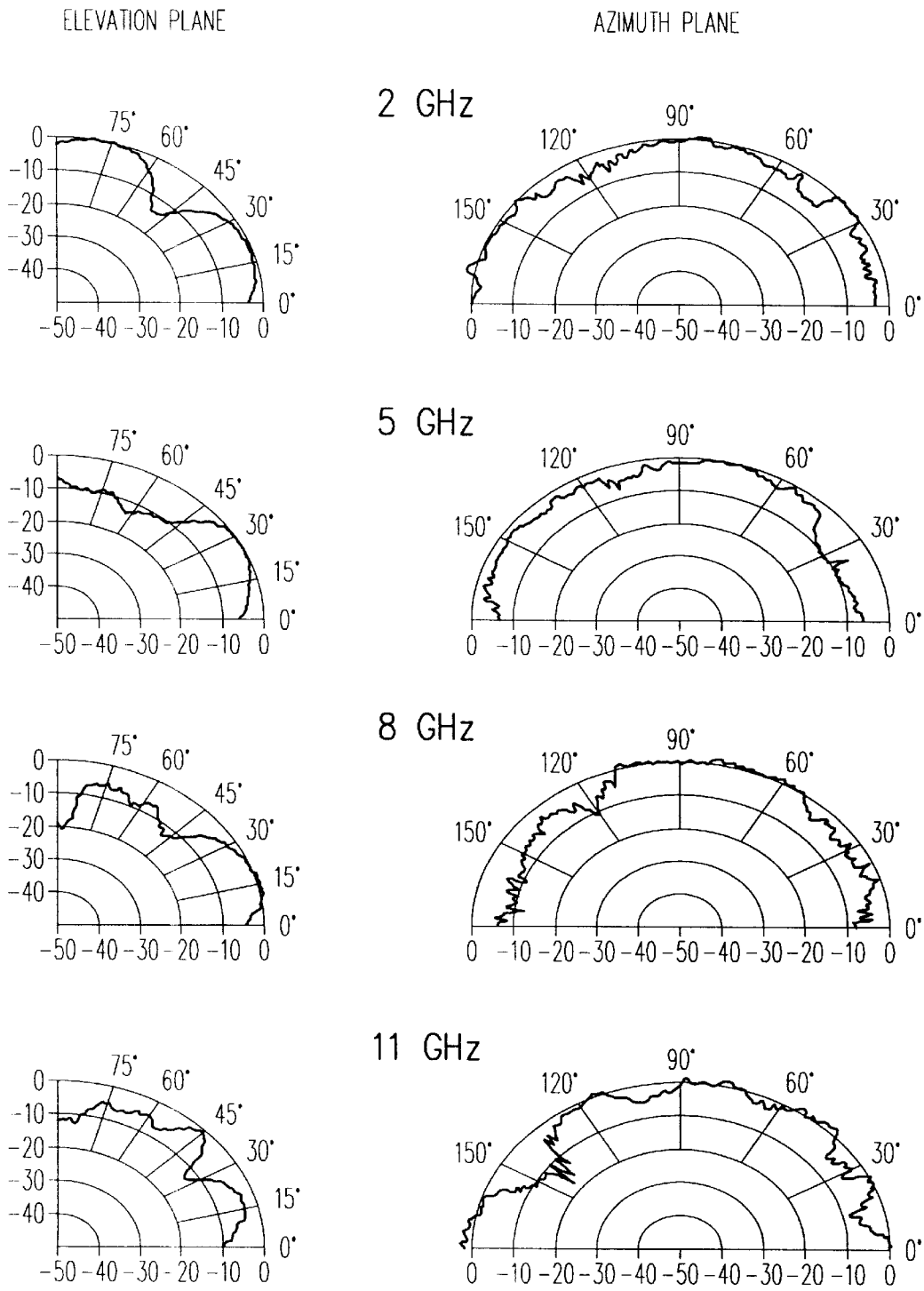

Radiation patterns of antenna 60 with a BST substrate of dielectric constant of about 50 were measured with a sweep frequency source within the band are reasonably consistent. The radiation patterns of four indicative frequencies (2, 6, 10 and 14 GHz) are shown in FIG. 9. In view of the wide band nature of the antenna only a few indicative frequencies are shown for the elevation and azumuthal coverage of antenna 60. One half of the spherical volume is obstructed by ground plane 26 and half of the remaining hemispherical volume is once again eliminated because of the use of absorber 62 behind substrate 22. This should not pose any serious difficulty from the applications point of view, since two antennas can be placed back to back on either side of an absorber to improve the coverage of the antenna. Similar results are shown in FIG. 10 for a lower dielectric BST of about 12. Due to the difference in the characteristics of this antenna, radiation patterns at 2, 5, 8 and 11 GHz are shown in FIG. 10.

Figure 5B:
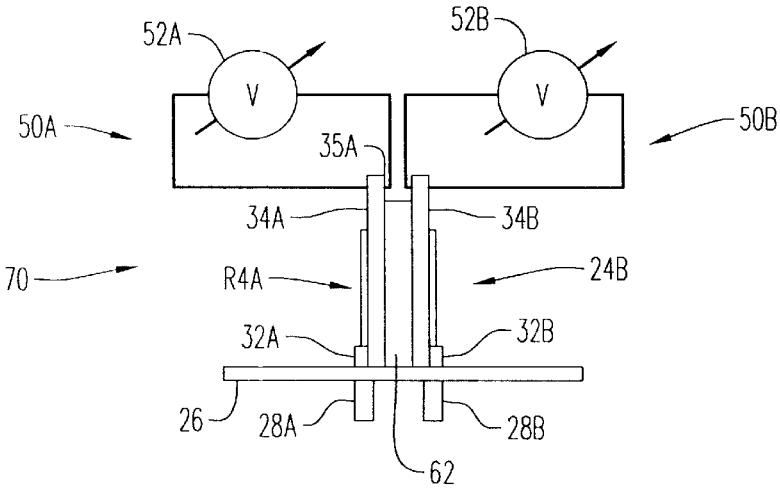
FIG. 5B is an elevational view of another antenna of the present invention.

Referring to FIG. 5B, another embodiment of the present invention is an antenna 70 that has some common parts with antennas 20 and 60 that bear the same reference numerals. Antenna 70 is capable of radiation in the hemispherical volume above ground plane 26. Antenna 70 includes a substrate 22A and a substrate 22B with absorber 62 sandwiched therebetween and supported perpendicular to ground plane 26. A fractal pattern layer 24A overlies surface 34A of substrate 22A and a fractal pattern layer 24B overlies a surface 34B of substrate 22B. Input feeds 28A and 28B are coupled to feed points 32A and 32B of layers 24A and 24B, respectively. Tuning means 52A and 52B are arranged to tune substrates 22A and 22B. For example, tuning means 50A includes variable voltage source 52A connected across substrate 22A with connections to surface 34A and opposed surface 35A.

The applications for the antennas of the present invention are immense. These antennas dramatically change the appearance of many telecommunications systems including military systems. For example, VHF/UHF antennas currently in use pose severe operational disadvantages due to their large sizes. Often the use of such antennas considerably curtails the freedom of movement of the personnel. Even the setting up of the communication system itself takes precious time, as the antennas are generally carried folded. An antenna placed conformal to the vehicle or on the backpack of the personnel therefore has tremendous military potential.

Antennas 60 and 70 have excellent performance characteristics and are small in size. The configuration of antennas 60 and 70 is adaptable to a conformal arrangement.

Figure 11A:
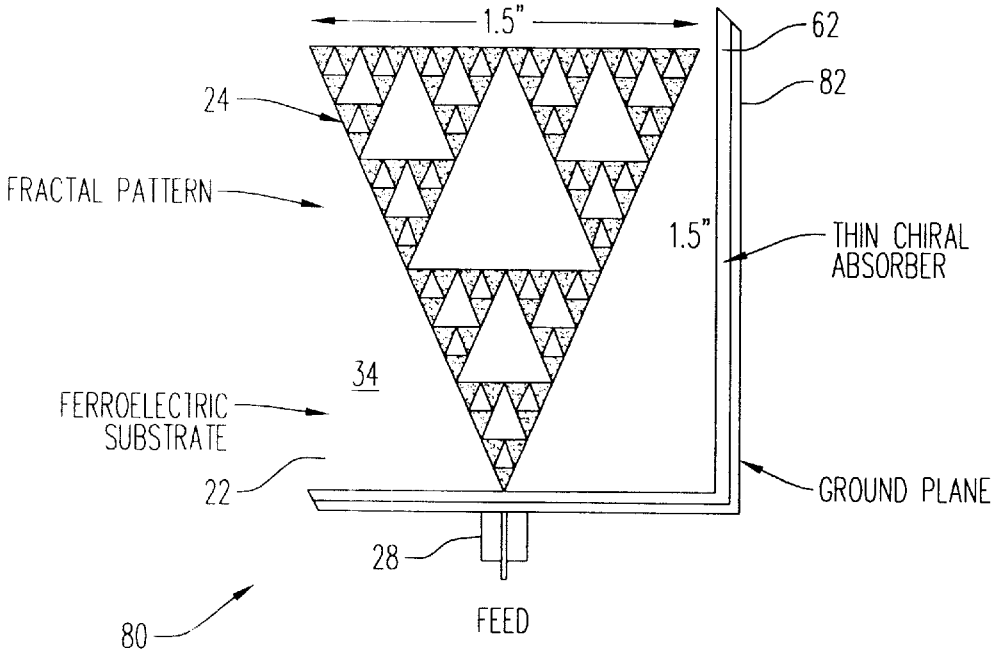
FIG. 11A is another embodiment of the antenna of the present invention.

Referring to FIG. 11A, an antenna 80 is similar to antennas 20, 60 and 70 with common parts bearing the same reference numerals. However, antenna 80 has a ground plane 82 that is parallel to absorber 62 and substrate 22. This configuration can be adapted to conform to a mounting surface, such as a vehicle, an item of clothing, or other gear with minimal interference to its outer profile.

Figure 12:
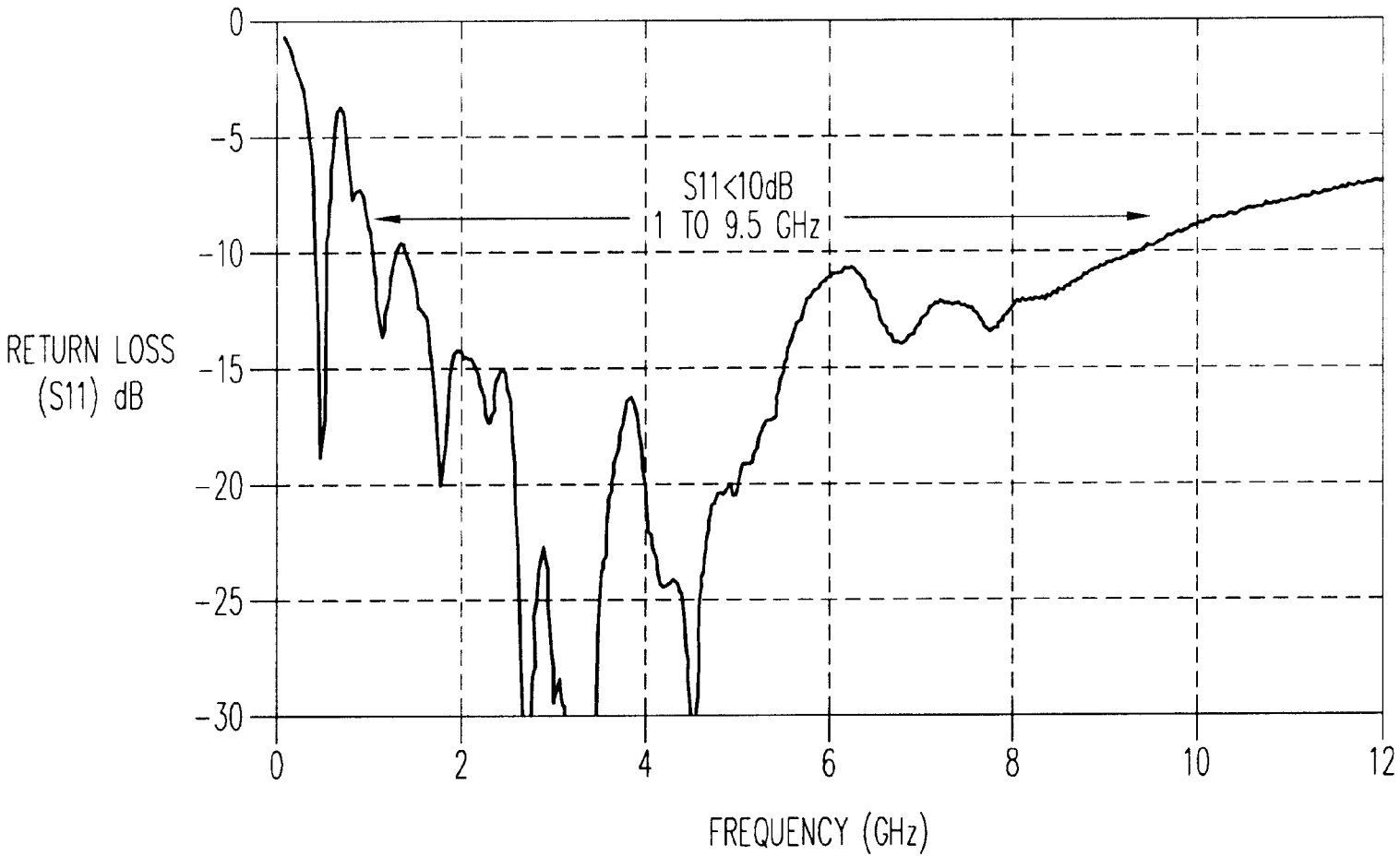
FIG. 12 is a graph depicting the frequency/return loss of the antenna of FIG. 11.

Referring to FIG. 12, antenna 80 has a wideband characteristic. The return loss remains well below −10 dB largely for the frequency region from 1 GHz to 10 GHz. This corresponds to a VSWR better than 2.2. Hence, antenna 80 can be operated anywhere in L, S, or C bands and partly in X-band.

Figure 13:
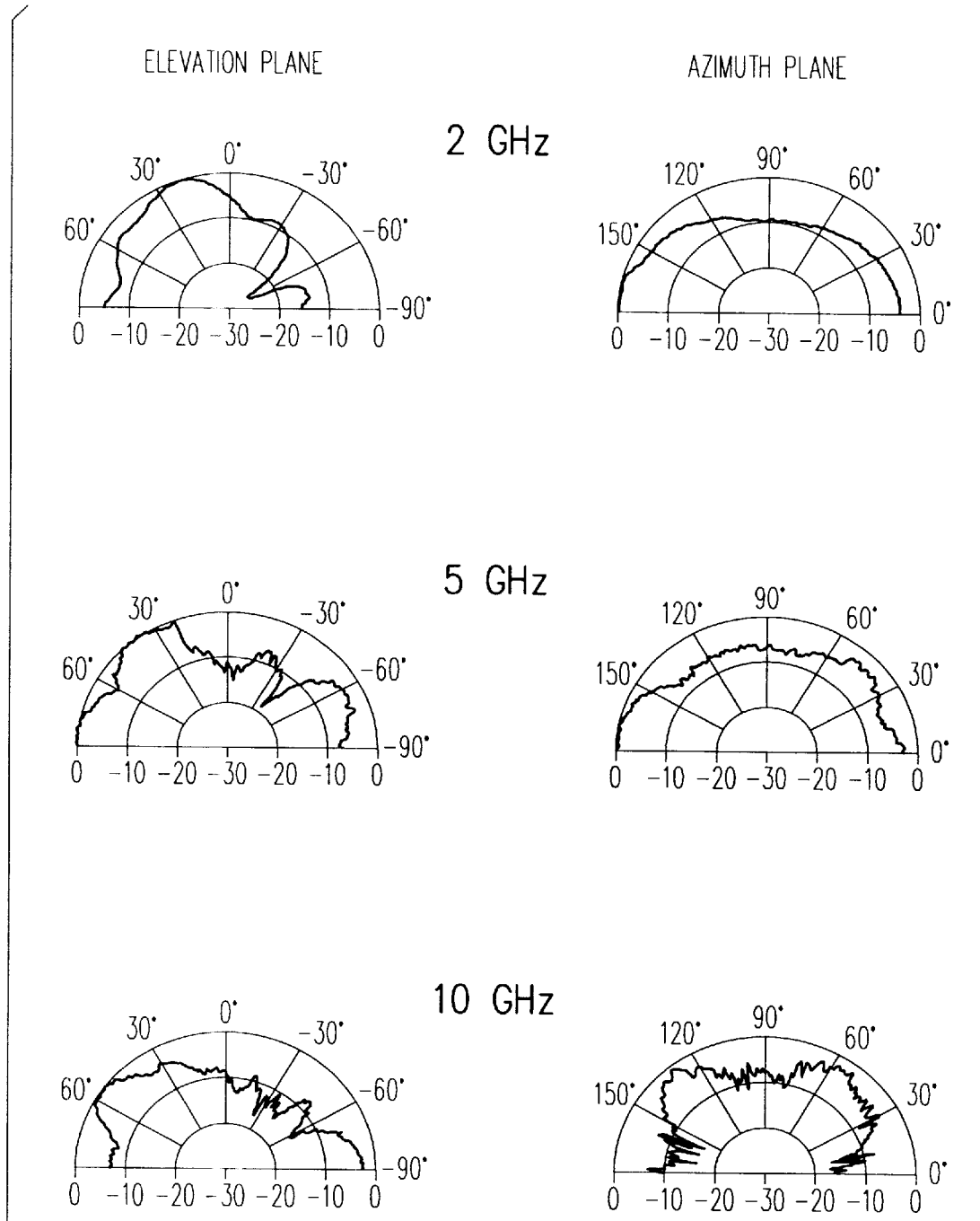
FIG. 13 depicts radiation patterns in the elevation and azimuth planes for different frequencies of the antenna of FIG. 11.

Referring to FIG. 13, the radiation patterns of antenna 80 are shown in elevation and azimuth at a few indicative frequencies. It may be noted that antenna 80 is not symmetrical, except in two octants, on either side of the plane perpendicular to the antenna patterns and along the feed direction. Therefore, the radiation patterns are given only for these regions. Nevertheless this should not pose any serious difficulty from the applications point of view, since two identical fractal radiators can be placed back to back on either side of an absorber to improve the coverage of the antenna. Another aspect worth mentioning is that the beam direction is neither normal to the antenna nor always exactly fixed, as with the multi-band fractal antenna described in the aforementioned article entitled *Fractal Multiband Antenna Based on Sierpinski Gasket.*

Figure 11B:
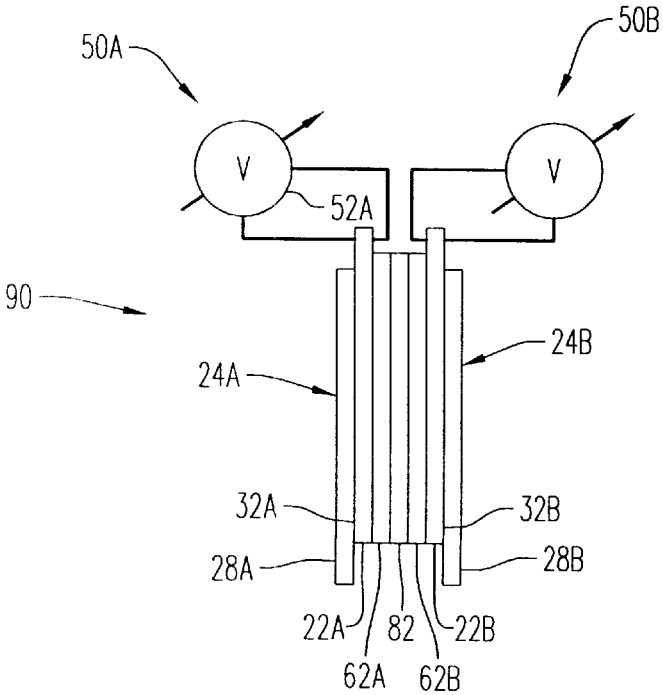
FIG. 11B is an elevational view of a further antenna embodiment of the present invention.

Referring to FIG. 11B, another embodiment of the present invention is an antenna 90 that has some common parts with antennas 20, 60 and 80 that bear the same reference numerals. Antenna 90 is capable of radiation in the hemispherical volume on either side of ground plane 82 and like antenna 80 is conformal. Antenna 90 includes on one side of ground plane 82 a fractal pattern layer 24A, a substrate 22A and an absorber layer 62A. Antenna 90 includes on the other side of ground plane 82 a fractal pattern layer 24B, a substrate 22B and an absorber layer 62B. Input feeds 28A and 28B are coupled to feed points 32A and 32B of layers 24A and 24B, respectively. Tuning means 52A and 52B are arranged to tune substrates 22A and 22B. For example, tuning means 50A includes variable voltage source 52A connected across substrate 22A.

Figure 14:
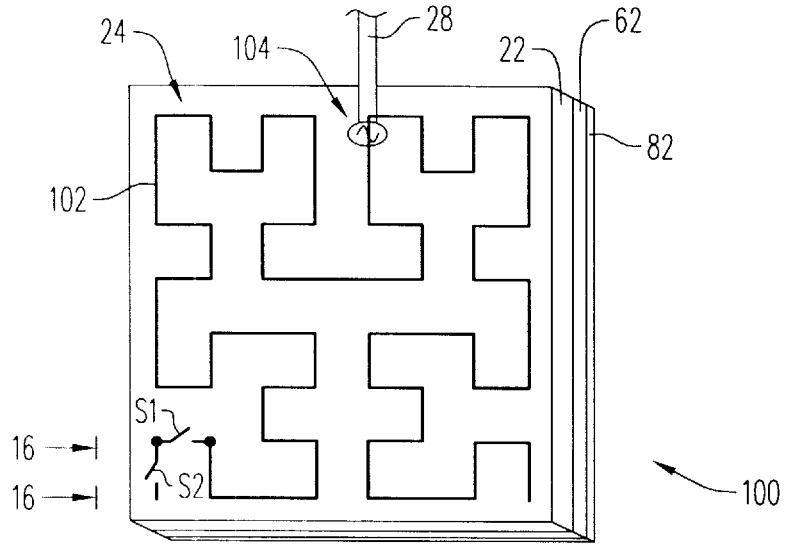
FIG. 14 is a perspective view of another alternative embodiment of the antenna of the present invention.

Referring to FIG. 14, an alternative embodiment is shown as an antenna 100, which is substantially identical to antenna 80 (FIG. 11A), except that conductive layer 24 is a reconfigurable Hilbert curve fractal pattern 102. Input feed 28 is coupled to a feed point 104. Hilbert curve fractal pattern 102 is reconfigurable by placing a switch in one or more of the line segments of the pattern. By way of example, a switch S1 and a switch S2 are shown in two different line segments. Antenna 100 also has a variable bias voltage (not shown) connected across substrate 22.

The input impedance of antenna 100 is defined as the impedance offered at its input terminals (input feed 28 and ground sheet 82). To improve impedance match of antenna 100 (particularly the real part thereof), the location of feed point 104 is moved along the fractal patter 102. Depending on the resonance order, a position can be identified to match the input characteristics of the antenna with that of the transmission line. The feed point position shown in FIG. 14 is the best impedance match for antenna outer dimension of 10.5 cm by 10.5 cm feed by a 50 ohm transmission line. Since the current distribution of the antenna remains the same, changes in the location of feed point 104 do not alter the radiation pattern of antenna 100.

Figure 15:
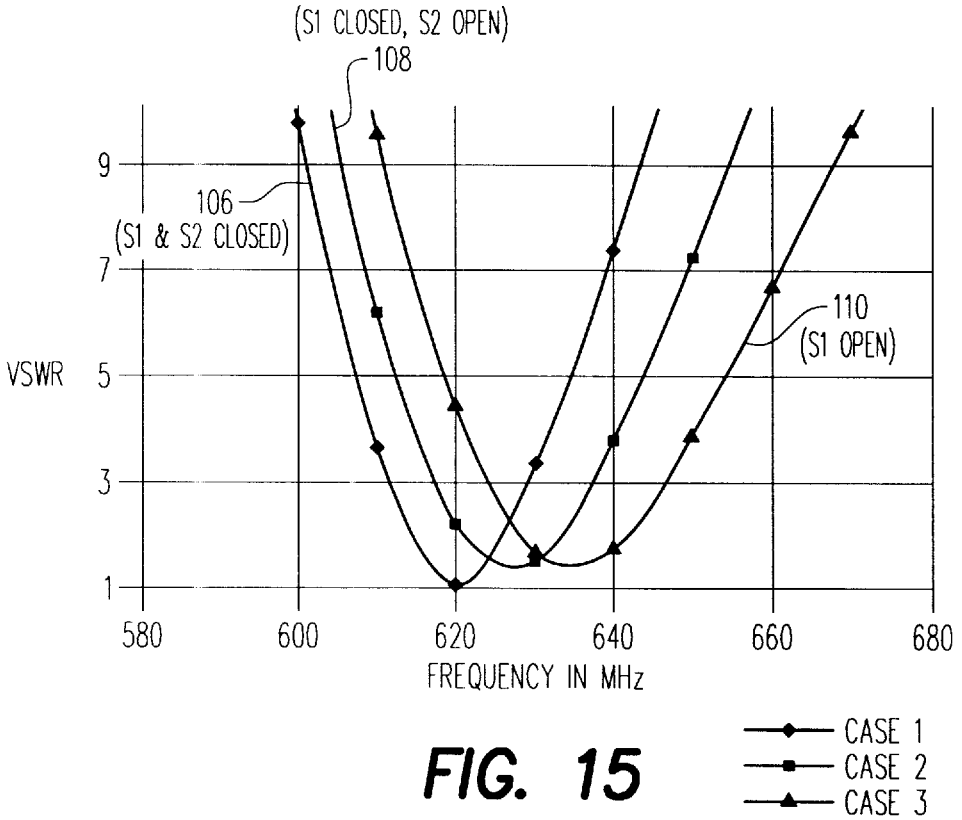
FIG. 15 is a graph depicting the voltage standing ratios for three configuration of the antenna of FIG. 14.

Referring to FIG. 15, curves 106, 108 and 110 are shown for different configurations of antenna 100 (for the 10.5 cm dimensions) based on the open/close status of switches S1 and S2. Curve 106 is for the case when both switches S1 and S2 are closed. Curve 106 has a voltage standing wave ratio (VSWR) of one at a resonant frequency of 620 MHz. Curve 108 is for the case when Switch S1 is closed and S2 is open. For this case the resonant frequency is about 630 MHz and the VSWR is about 1.5. Curve 110 is for the case when switch S1 is open (the status of switch S2 is irrelevant). For this case the resonant frequency is about 635 MHz and VSWR is about 1.5. Although the change in VSWR affects the input impedance match of the antenna, there is no appreciable change in radiation characteristics. Thus, antenna 100 can be frequency tuned by truncating the length of fractal pattern 102.

Switches S1 and S2 may be any suitable switch that can perform the switching of the line segments of the fractal pattern 102, such as RF switches, which may be either pin diode based or microelectromechanical systems (MEMS) based, and the like. Referring to FIG. 16, an example of a MEMS switch is shown for switch S1. Switch S1 is disposed in a line segment of fractal pattern 102 having segment parts 112 and 114. Switch S1 includes an electrically conductive cantilever beam 116 that is connected to segment part 112. A layer of dielectric material, e.g., barium strontium titanate 118, is disposed on segment part 114. Switch S1 is shown in its open position in FIG. 16. To close switch S1, a small dc voltage (on the order of about 5 volts) is applied between segment part 114 and cantilever beam 116.

Referring to FIG. 17, a plurality of radiation pattern plots for the xy plane are shown for the cases identified as case (a), case (b), case (c) and case (d). These cases are for different configurations of antenna as implemented by the bold thick line shorting segments shown in the fractal patterns adjacent the radiation plots. For these radiation plots, the antenna lies entirely in the xy ($\phi$) plane and has the aforementioned 10.5 cm dimensions. The case (a) plot is for the situation where fractal pattern is unperturbed by any shorting segments. As can be seen, the shape of the beam can be changed by selective placement of the shorting segments. For comparison purposes, FIG. 18 shows the radiation pattern for case (a), in the $\theta$ plane. Only half of the pattern is shown because of symmetry. A plot 122 is for $\phi=0$ and a curve 124 is for $\phi=90°$.

Figure 19:
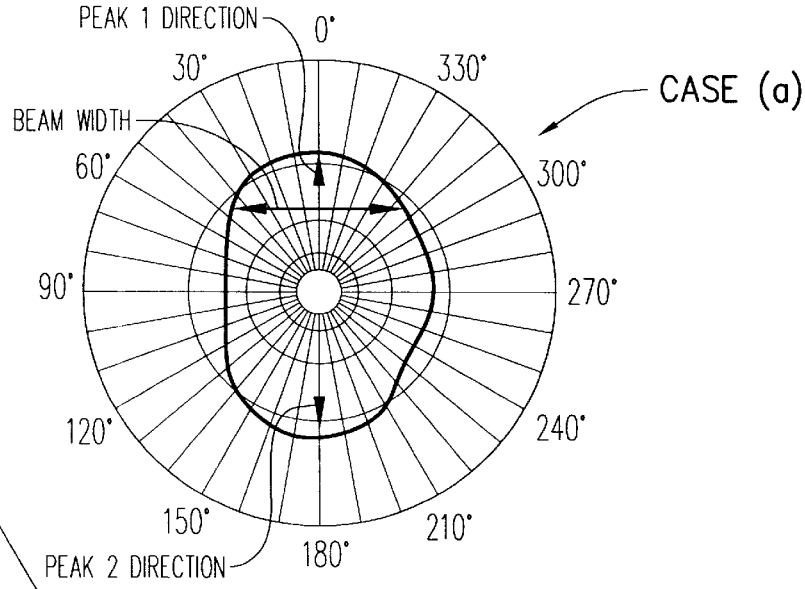
FIG. 19 is a table summarizing beam characteristics of various configurations of the antenna of FIG. 14.

Referring to FIG. 19, a table 100 summarizes the beam peak directions, antenna gain and beam width for case (a), case (b), case (c) and case (d). Case a is reproduced in FIG. 18 with the peak directions 1 and 2 and the beam width labeled so as to define the data in table 100.

It will be apparent to those skilled in the art that although the reconfigurable feature of the invention has been shown for the antenna structure of FIG. 11A, it can also be implemented in the antenna structures of FIG. 1A or FIG. 5A as well as other structures.

Figure 20:
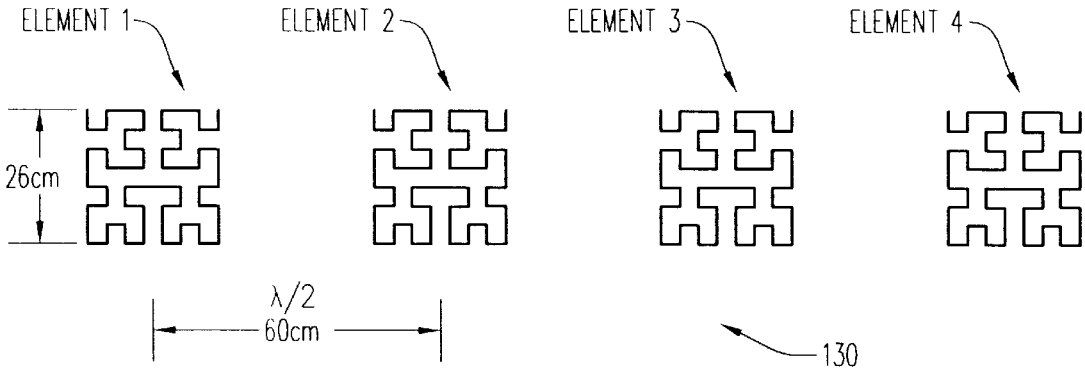
FIG. 20 is a schematic diagram of another alternative embodiment of the antenna of the present invention.

Referring to FIG. 20, another alternative embodiment of the antenna of the invention is a phased array antenna 130. Phased array antenna includes a plurality of fractal elements arranged in an array. Although only four elements, element 1, element 2, element 3 and element 4, are shown in an in-line order, more or less elements can be used in other arrays. For example, the array may include a rectangular or matrix arrangement of elements.

Each element may be a discrete antenna, such as antenna 20, 60, 70, 80, 90 or 100, or alternatively may share a common substrate. Whether implemented with descrete antenna elements or with a shared substrate, The individual element size is less than a half wavelength ($\lambda/2$). This increases the electrical gap between adjacent elements, thereby reducing mutual coupling between elements and leading to better array performance.

Figure 21:
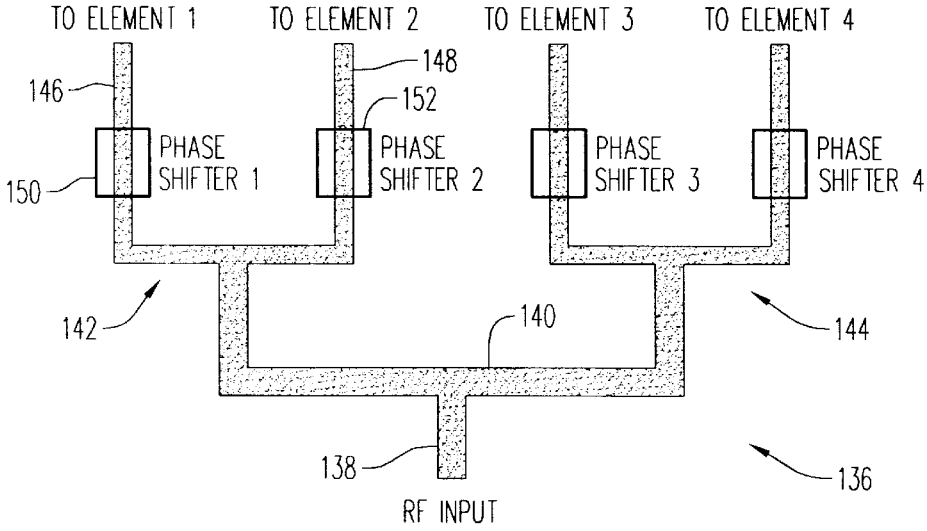
FIG. 21 is a diagram of a feeder network for the antenna of FIG. 20.

Referring to FIG. 21, a feeder network 136 has a common RF feed 138, that is coupled via a splitter 140 to branches 142 and 144. Branch 142 includes arms 146 and 148 that are coupled to elements 1 and 2, respectively, of phased array antenna 130. Arms 146 and 148 include phase shifters 150 and 152, respectively. Branch 144 is substantially identical to branch 142, except that it is coupled to elements 3 and 4 of phased array antenna 130.

Phase shifters 150 and 152 may be any suitable RF phase shifter. Preferably, phase shifters are MEMs based that will result in lower insertion loss and smaller sizes, particularly at microwave frequencies.

Figures 22, 23:
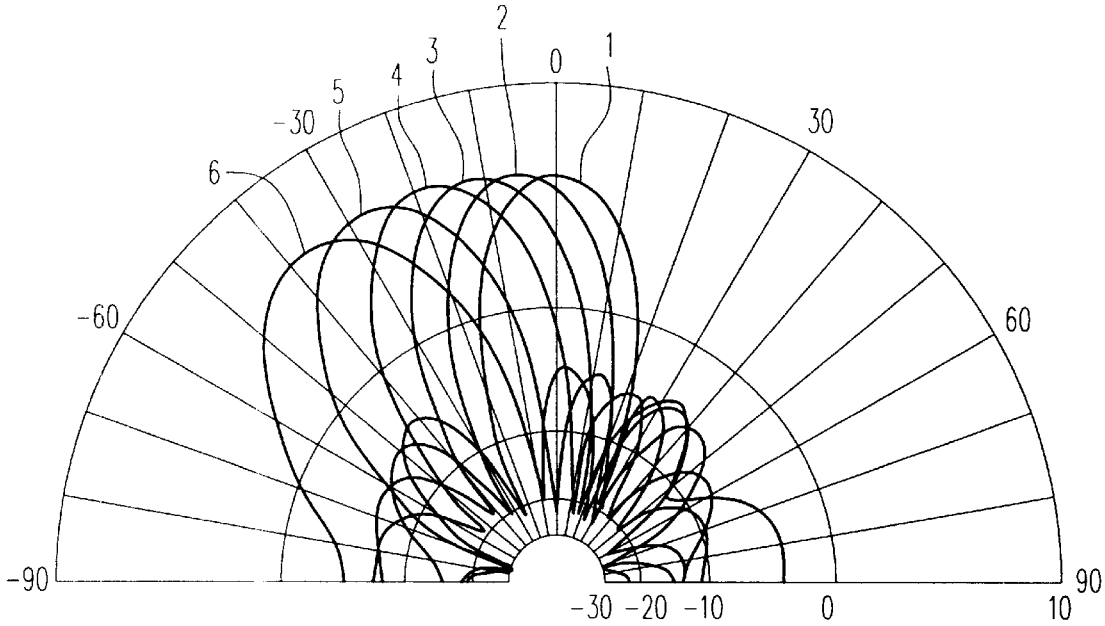
FIG. 22 depicts several radiation patterns for different phase shift scenarios of the antenna of FIG. 20.
FIG. 23 is a table summarizing the beam direction and phase shift status for the different phase shift scenarios of FIG. 20.

Referring to FIG. 22, radiation patterns of the phased array antenna 130 are shown for six different phase shift cases. Referring to FIG. 23, a table 158 summarizes phase shift of each element and the beam direction for each of the six different cases. The radiation patterns of FIG. 22 and table 158 of FIG. 23 show that a steerability of 40° is obtainable with an incremental phase shift of 120° between adjacent elements.

The wideband characteristics, moderate gain and conformal characteristics of the antenna of the present invention give it a huge potential of applications. The antennas of the invention dramatically change the appearance of many communication devices and systems. For example, VHF/UHF antennas currently in use pose severe operational disadvantages due to their large sizes. Often the use of such current antennas considerably curtails the freedom of movement of the user.

The size of the antenna of the present invention is typically of the order of few square inches (thickness of the order of half an inch). The wideband antenna configuration described herein is capable of covering the VHF/UHF bands used in TV broadcast reception. The antenna is much smaller than the commonly used antennas like parabolic dish, log periodic array antennas etc.

Many antenna applications in the UHF/UHF region do not require such wide bandwidths. The fractal antennas of the invention are capable of operating in narrow bandwidths with multi-functional capabilities, which is suitable for maritime telephone, air telephone, train telephone, pager, aircraft communication, IMMERSAT, Tech SAT etc. The space filling property of the Hilbert curve, along with high dielectric substrate materials can be used to realize small antennas for UHF antennas for SATCOM and LOS communications, HF communications data-links, personnel antennas, amateur radios, mobile-mobile, air-air and air-ground communication. The antennas of the invention can also be used in phased arrays operating at narrow VHF bands.

The radiation characteristics of some of these antennas (e.g., Hilbert Curve) are found to be orientation independent.

When attached to moving sensors, these antennas can be used in wireless sensors operational at VHF/UHF frequencies. The antenna polarization of circularly symmetric fractal antennas can be made circularly polarized by suitable choosing the feed location. By modifying the scale factors of the fractal iterations, the resonant frequencies can be located at the desired frequencies. These antennas can therefore find applications in low profile global positioning system (GPS) receivers.

The fractal multiband antennas can be used as transmit/receive antennas in up/down link for satellite communications in the C-band. The resonance of the antenna can be located to the frequencies of interest (i.e., 3.85–4.2 GHz for downlink and 5.75–6.15 GHz for uplink). Fractal patterns, such as the Sierpinski gasket, can also be used in spatial filtering for satellite communication bands. A good isolation between the pass and stop bands can be obtained with the use of these fractal screens.

The fractal antenna of the present invention may be useful in at least the following applications:

| | | |
|---|---|---|
| 1. | Mobile telephone | : 250 MHz |
| 2. | Air telephone | : 800 MHz |
| 3. | Train telephone | : 400 MHz |
| 4. | Pager | : 150, 250, 450, 900 MHz |
| 5. | IMMERSAT | : 1.5 GHz |
| 6. | LOS | : 225 to 400 MHz |
| 7. | GPS | : 1.227, 1.575 GHz |
| 8. | SATCOM | |
| 9. | TV channel (example) | : 470–862 MHz |
| 10. | C-band satellite | : 3.4 to 4.2 GHz and 5.85 to 6.7 GHz |

The present invention having been thus described with particular reference to the preferred forms thereof, it will be obvious that various changes and modifications may be made therein without departing from the spirit and scope of the present invention as defined in the appended claims.

What is claimed is:

1. An antenna comprising:

a substrate having a dielectric constant of at least 10;

at least one layer of electrically conductive material overlying a surface of said substrate, wherein said layer of electrically conductive material comprises a fractal pattern;

a sheet of electrically conductive material disposed substantially perpendicular to said surface of said substrate to provide a ground plane; and means for applying a bias voltage across said substrate to tune said antenna for operation in at least one frequency band.

2. The antenna of claim 1, further comprising an input feed coupled to said at least one layer of electrically conductive material.

3. The antenna of claim 1, wherein said substrate comprises a ferroelectric material.

4. The antenna of claim 3, wherein said ferroelectric material is barium strontium titanate.

5. The antenna of claim 1, wherein said fractal pattern is selected from the group consisting of Hilbert curve, Koch curve, Sierpinski gasket, Sierpinski carpet and mixtures thereof.

6. The antenna of claim 1, wherein said means for tuning comprises a variable voltage.

7. The antenna of claim 1, wherein said dielectric constant is in the range of about 10 to 200.

8. The antenna of claim 1, wherein said dielectric constant is in the range of about 200 to 600 and higher.

9. An antenna comprising:

a substrate having a dielectric constant of at least 10;

at least one layer of electrically conductive material overlying a surface of said substrate, wherein said layer of electrically conductive material comprises a fractal pattern;

a sheet of electrically conductive material disposed in relation to said substrate to provide a ground plane;

means for applying a bias voltage across said substrate to tune said antenna for operation in at least one frequency band; and a layer of absorbing material overlying an opposed surface of said substrate, wherein said absorbing material layer smoothens the frequency/return loss characteristic of said antenna.

10. The antenna of claim 9, wherein said sheet of electrically conductive material is disposed substantially parallel to said surface of said substrate.

11. The antenna of claim 9, wherein said absorbing material is a chiral material.

12. An antenna comprising:

a substrate having a dielectric constant of at least 10;

at least one layer of electrically conductive material overlying a surface of said substrate, wherein said layer of electrically conductive material comprises a fractal pattern, wherein said fractal pattern has a plurality of segments arranged in a first configuration;

at least one switch disposed to change said first configuration to a second configuration;

a sheet of electrically conductive material disposed in relation to said substrate to provide a ground plane; and means for applying a bias voltage across said substrate to tune said antenna for operation in at least one frequency band.

13. The antenna of claim 12, wherein said fractal pattern is a Hilbert curve.

14. An antenna comprising:

first and second assemblies that each comprise:

a substrate of dielectric material having a first surface and a second surface; and at least one layer of electrically conductive material comprising a fractal pattern overlying said first surface of said substrate; and a layer of absorbing material disposed between the second surfaces of said first and second assemblies; and a sheet of electrically conductive material disposed in relation to said first and second assemblies so as to serve as a ground plane.

15. The antenna of claim 14, wherein each of said substrates has a dielectric constant of at least 10.

16. The antenna of claim 14, wherein said dielectric material comprises a ferroelectric.

17. The antenna of claim 16, wherein said ferroelectric comprises barium strontium titanate.

18. The antenna of claim 14, wherein said absorbing layer comprises a chiral material.

19. The antenna of claim 14, wherein said sheet of electrically conductive material is disposed substantially perpendicular to said first and second assemblies.

20. The antenna of claim 14, wherein said sheet of electrically conductive material is disposed substantially parallel to said first and second assemblies.

21. The antenna of claim 14, wherein said absorbing layer is a first absorbing layer disposed in overlying relation to said second surface of said first assembly, and further comprising a second absorbing layer disposed in overlying relation to said second surface of said second assembly, and wherein said sheet of electrically conductive material is disposed between said first and second absorbing layers.

22. The antenna of claim 14, wherein said first and second surfaces are opposed surfaces.

23. The antenna of claim 14, wherein said fractal pattern is selected from the group consisting of Hilbert curve, Koch curve, Sierpinski gasket and Sierpinski carpet.

24. The antenna of claim 14, wherein said fractal pattern has a plurality of segments arranged in a first configuration, and further comprising at least one switch disposed to change said first configuration to a second configuration.

25. The antenna of claim 14, wherein said fractal pattern is a Hilbert curve.

26. The antenna of claim 14, wherein said dielectric constant is in the range of about 10 to 200.

27. The antenna of claim 14, wherein said dielectric constant is in the range of about 200 to 600.

28. The antenna of claim 14, further comprising means for applying a bias voltage across at least one of said substrates to tune said antenna for operation in at least one frequency band.

29. An antenna comprising:

a substrate that comprises a dielectric material;

at least one layer of electrically conductive material overlying a surface of said substrate, wherein said layer of electrically conductive material comprises a fractal pattern that has a plurality of segments arranged in a first configuration; and at least one switch disposed to change said first configuration to a second configuration.

30. The antenna of claim 29, wherein said fractal pattern is a Hilbert curve.

31. The antenna of claim 29, wherein said dielectric material has a dielectric constant of at least 10.

32. The antenna of claim 29, wherein said dielectric material comprises a ferroelectric.

33. The antenna of claim 29, wherein said switch is selected from the group that consists of radio frequency switch, pin diode and MEM.

34. The antenna of claim 29, further comprising means for applying a bias voltage across said substrate.

35. The antenna of claim 34, wherein said bias voltage tunes said antenna for operation in a particular frequency range.

36. The antenna of claim 29, further comprising a body of electrically conductive material disposed in relation to said substrate to serve as a ground plane.

37. The antenna of claim 29, wherein said at least one layer is one of a plurality of layers of electrically conductive material overlying said surface of said substrate, wherein each of said layers of electrically conductive material comprises a fractal pattern that has a plurality of segments arranged in a first configuration.

38. The antenna of claim 37, further comprising a feed network having phase shifting capability to deliver signals to said plurality of layers.

39. The antenna of claim 37, wherein said fractal pattern is a Hilbert curve.

40. An antenna comprising:

a substrate having a dielectric constant of at least 10;

at least one layer of electrically conductive material overlying a surface of said substrate, wherein said layer of electrically conductive material comprises a fractal pattern;

a sheet of electrically conductive material disposed in relation to said substrate to provide a ground plane;

means for applying a bias voltage across said substrate to tune said antenna for operation in at least one frequency band, wherein said at least one layer is one of a plurality of layers of electrically conductive material overlying said surface of said substrate, wherein each of said layers of electrically conductive material comprises a fractal pattern; and a feed network having phase shifting capability to deliver signals to said plurality of layers.

41. The antenna of claim 40, wherein said fractal pattern has a plurality of segments configured in a pattern.

42. The antenna of claim 41, wherein said pattern is a Hubert curve,

43. An antenna comprising:

at least one assembly that comprises:

a substrate that comprises a dielectric material;

at least one layer of electrically conductive material overlying a surface of said dielectric substrate, wherein said layer of electrically conductive material comprises a fractal pattern; and a sheet of electrically conductive material disposed in relation to said dielectric substrate to provide a ground plane; and means for applying a bias voltage across said substrate to tune said antenna for operation in at least one frequency band, wherein said at least one assembly is one of a plurality of substantially identical assemblies disposed in an array.

44. The antenna of claim 43, wherein said substrates of said assemblies are descrete separate substrates.

45. The antenna of claim 44, wherein said substrates of said assemblies are a common substrate that the electrically conductive layers of each assembly overlie.

46. The antenna of claim 43, wherein said sheet of electrically conductive material is disposed substantially perpendicular to said surface of said substrate.

47. The antenna of claim 43, wherein said sheet of electrically conductive material is disposed substantially parallel to said surface of said substrate.

48. The antenna of claim 43, wherein said substrate comprises a ferroelectric material.

* * * * *